US009041752B2

(12) United States Patent
Murata et al.

(10) Patent No.: US 9,041,752 B2
(45) Date of Patent: May 26, 2015

(54) PRINTER

(71) Applicant: Brother Kogyo Kabushiki Kaisha, Nagoya-shi, Aichi (JP)

(72) Inventors: Susumu Murata, Konan (JP); Kiyoichi Ohta, Nagoya (JP); Hisako Tonishi, Aichi-gun (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/327,785

(22) Filed: Jul. 10, 2014

(65) Prior Publication Data

US 2015/0015658 A1 Jan. 15, 2015

(30) Foreign Application Priority Data

Jul. 10, 2013 (JP) ..... 2013-144801
Jul. 10, 2013 (JP) ..... 2013-144802

(51) Int. Cl.

| | |
|---|---|
| ***B41J 3/407*** | (2006.01) |
| ***B41F 17/00*** | (2006.01) |
| ***B41F 17/08*** | (2006.01) |
| ***B41F 17/10*** | (2006.01) |
| ***B41J 15/04*** | (2006.01) |

(52) U.S. Cl.

CPC ..... *B41J 15/044* (2013.01); *B41F 17/10* (2013.01); *B41F 17/08* (2013.01); *B41F 17/00* (2013.01)

(58) Field of Classification Search

USPC ..... 347/171, 197, 198; 400/120.01, 120.16, 400/120.17

See application file for complete search history.

(56) References Cited

U.S. PATENT DOCUMENTS 5,184,152 A * 2/1993 French ..... 347/197
6,005,595 A * 12/1999 Vanwey ..... 347/171
6,025,860 A * 2/2000 Rosenfeld et al. ..... 347/171

FOREIGN PATENT DOCUMENTS

JP H06-74345 U 10/1994
JP H08-238821 A 9/1996
JP 2001-260257 A 9/2001

* cited by examiner

*Primary Examiner* — Huan Tran
(74) *Attorney, Agent, or Firm* — Banner & Witcoff, Ltd.

(57) ABSTRACT

The disclosure discloses a printer performing printing processing that forms desired print on a print-receiving medium. The printer includes a cartridge holder, a drive device, a thermal head, an energization device, an attribute detecting device, a first determination portion, and a processing portion. The cartridge holder removably mounts a cartridge. The drive device drives a feeding roller to feed the print-receiving medium. The thermal head performs printing on the print-receiving medium fed. The energization device controls energization of the thermal head. The attribute detecting device detects an attribute of the print-receiving medium. The first determination portion determines whether or not a tube cartridge capable of supplying a tubular print-receiving medium is mounted. The processing portion performs predetermined processing that is for suppressing expansion of the tubular print-receiving medium and is triggered by the determination that the tube cartridge has been mounted by the first determination portion.

15 Claims, 14 Drawing Sheets

PRINTER

CROSS-REFERENCE TO RELATED APPLICATION

The present application claims priority from Japanese Patent Application No. 2013-144801, which was filed on Jul. 10, 2013 and Japanese Patent Application No. 2013-144802, which was filed on Jul. 10, 2013, the disclosures of which are incorporated herein by reference in its entirety.

BACKGROUND

The present disclosure relates to a printer that forms print on a print-receiving medium.

FIELD

A printer that forms print on a tubular print-receiving medium has been known. According to the prior art, a tubular print-receiving medium (mark tube) is fed from a tube cartridge capable of supplying the print-receiving medium, and a thermal head (thermal transfer printing head) forms desired print on the fed print-receiving medium. A user can use the tubular print-receiving medium on which the print is formed as a tube with print.

However, as described above, when the print-receiving medium has a tubular shape, as the above described print is sequentially formed, air is easily accumulated inside a tube-shaped structure when the air inside the tube moves to an upstream side of a position of a feeding roller. The air once accumulated therein can be hardly removed. As a result, the tube-shaped structure expands with the accumulated air, which may cause a feeding failure inside the tube cartridge. The above described prior art did not have much consideration on this point.

SUMMARY

An object of the present disclosure is to provide a printer capable of suppressing occurrence of the feeding failure inside the tube cartridge.

In order to achieve the above-described object, according to the aspect of the present application, there is provided a printer configured to perform printing processing that forms desired print on a print-receiving medium, comprising a cartridge holder configured to removably mount a cartridge configured to feed out and sequentially supply the print-receiving medium, a drive device configured to drive a feeding roller configured to feed the print-receiving medium supplied from the cartridge, a thermal head configured to perform printing on the print-receiving medium fed by the feeding roller, an energization device configured to control energization of the thermal head, an attribute detecting device configured to detect an attribute of the print-receiving medium in the cartridge mounted on the cartridge holder, a first determination portion configured to determine whether or not a tube cartridge capable of supplying a tubular print-receiving medium is mounted, based on a detection result of the attribute detecting device, and a processing portion configured to perform predetermined processing that is for suppressing expansion of the tubular print-receiving medium and is triggered by the determination that the tube cartridge has been mounted by the first determination portion.

The printer of the present disclosure includes a cartridge holder. The cartridge holder can mount a tube cartridge capable of supplying a tubular print-receiving medium. When the tube cartridge is mounted and used, a feeding roller driven by a drive device feeds the tubular print-receiving medium from the tube cartridge. A thermal head energized by an energization device forms desired print on the fed print-receiving medium. The user can use the tubular print-receiving medium on which the print is formed as described above as a tube with print.

When the print-receiving medium has the tubular shape as described above, as the above described printing processing is sequentially performed, air inside the tube is moved to an upstream side of a position of the feeding roller. Thus, the air is easily accumulated inside the tube-shaped structure, and the air once accumulated therein can be hardly removed. As a result, the tube-shaped structure expands with the accumulated air, which may cause the feeding failure inside the tube cartridge.

Therefore, the disclosure of the present application provides an attribute detecting portion and an accumulation portion. In other words, when the cartridge is mounted in the cartridge holder, the attribute detecting device detects the attribute of the print-receiving medium in the cartridge. When the tube cartridge for supplying the tubular print-receiving medium as described above is mounted, a determination by the first determination portion is satisfied based on the detection result of the above described attribution detecting device.

On the other hand, as described above, when the printing processing is sequentially performed, the accumulation portion accumulates the printing length in a transport direction by the thermal head or the feeding length by the feeding roller. At this point, from a point of view of determining a feeding operation state of the print-receiving medium causing the above described air movement, a predetermined limit value is defined on an accumulation value of the above described accumulation portion. When the thermal head performs the printing processing sequentially for a certain period, the accumulation value of the above described printing lengths or feeding lengths reaches the above described limit value, and the determination by the second determination portion is satisfied.

When the determinations by the first and second determination portions are satisfied, in other words, when the printing processing is performed sequentially on the tubular print-receiving medium with the tube cartridge mounted for a certain period, the processing portion performs predetermined processing for suppressing expansion of the tubular print-receiving medium.

For example, there is a case where a relative positional relationship between the feeding roller and the thermal head is configured to be switchable by a switch device between a pressing state (state where the feeding roller presses the print-receiving medium onto the thermal head with a predetermined pressing force) and a separation state (state where the feeding roller separates away from the print-receiving medium). In such a case, depending on a feeding operation state of the print-receiving medium when the printing processing is performed, which directly causes the air movement, the above described switch device for removing the above described accumulated air is controlled. In other words, a switch control portion controls the above described switch device to switch the relative positional relationship between the above described feeding roller and thermal head from the above described pressing state corresponding to execution of the above described printing processing to the above described separation state, and then further to the pressing state.

More specifically, for example, at predetermined timing before the printing processing in operation is ended, the above described switching is performed, or before the printing processing is started, the above described switching is performed. As described above, the above described pressing state is once switched to the separation state during the printing processing so that the print-receiving medium is released from the pressed state between the feeding roller and the thermal head. As a result, even if, as described above, the air is accumulated in the tube-shaped structure, the accumulated air can be removed from a tube edge to an outside. As a result, expansion of the above described tube-shaped structure with the accumulated air can be suppressed, and occurrence of the feeding failure inside the tube cartridge can be suppressed.

Alternatively, for example, a limit control portion is provided to perform predetermined limit on the printing processing, depending on the feeding operation state of the print-receiving medium when the printing processing is performed, which directly causes the air movement. In other words, the limit control portion controls the drive device and the energization device in coordination with each other to perform the predetermined limit on the above described printing processing. More specifically, for example, the printing processing in operation is stopped and, after the printing processing (or a part of the printing processing) in operation is completed, subsequent printing processing is prohibited. With the arrangement, by natural air leakage in a predetermined period until the above described stop or above described prohibition of the printing processing is released, an amount of the air in the tube is decreased. As a result, expansion of the above described tube-shaped structure with the accumulated air can be reduced, and occurrence of the feeding failure inside the tube cartridge can be suppressed.

DETAILED DESCRIPTION OF THE PREFERRED EMBODIMENTS

With reference to diagrams, a printer according to a first embodiment of the present disclosure will be described below.

With reference to FIGS. 1-8, the first embodiment of the present disclosure will be described.

<Outline of External Appearance of Apparatus>

Figure 1:
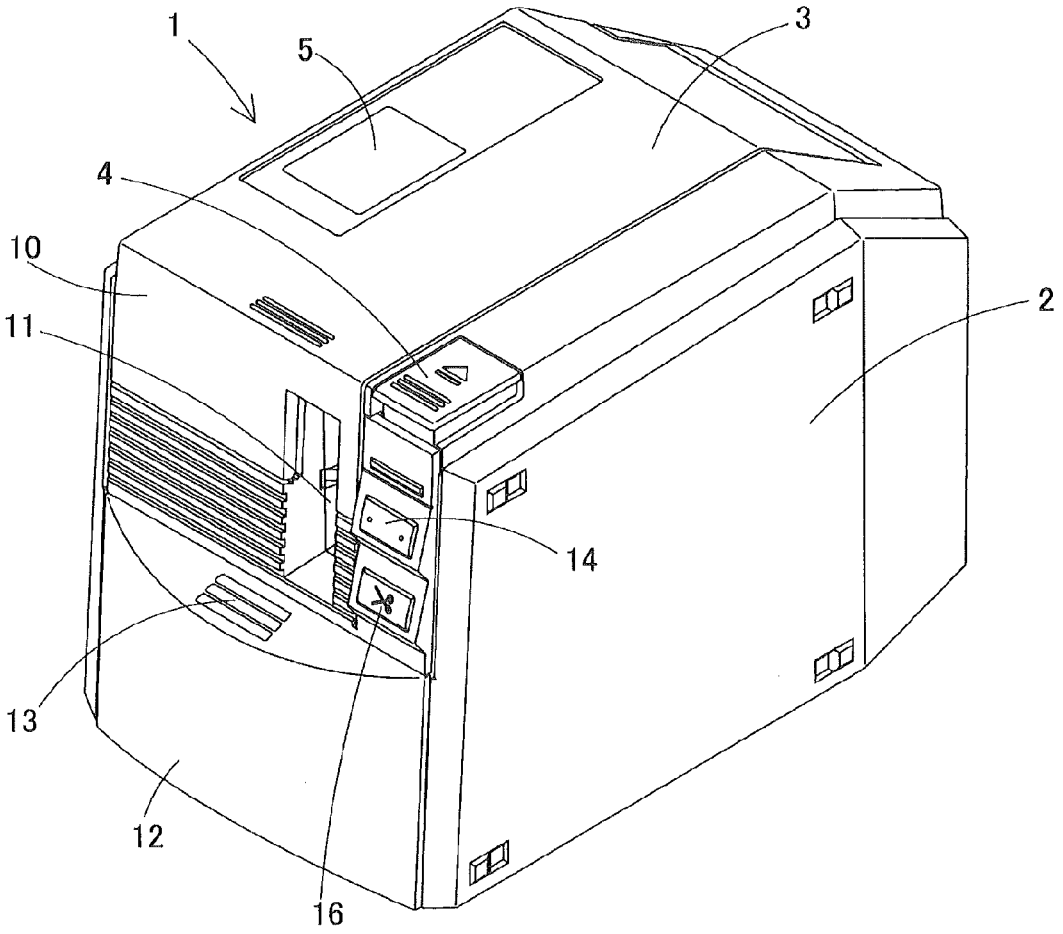
FIG. 1 is a perspective view illustrating an external appearance of a printer according to a first embodiment of the present disclosure.

According to the example, a printer 1 according to the present embodiment illustrated in FIG. 1 is connected to a PC 118 (refer to FIG. 6 described below) as an operation terminal via a wired or wireless communication line (not illustrated) and, based on a user's operation from the PC 118, produces desired printed matter (details will be described below). The printer 1 is not limited to a configuration in which it is connected to the operation terminal, but may have a configuration (so-called, stand-alone type) in which the printed matter is produced based on the user's operation to an appropriate operation part provided in the printer 1.

As illustrated in FIG. 1, the printer 1 includes an apparatus main body 2 and an opening and closing lid 3 provided to be freely opened and closed on a top face of the apparatus main body 2.

The apparatus main body 2 includes a front wall 10 that is located on a front side (front left side in FIG. 1) and includes a printed matter discharging exit 11 for discharging the printed matter produced in the apparatus main body 2 to an outside, and a front lid 12 which is provided below the printed matter discharging exit 11 of the front wall 10 and the lower edge of which is rotatably supported.

The front lid 12 includes a pressing portion 13, which is pressed from above to open the front lid 12 forward. Further, a power button 14 for turning a power of the printer 1 on and off is provided on one edge portion of the front wall 10. Below the power button 14, a cutter driving button 16 is provided for driving a cutting mechanism 15 (refer to FIG. 2 described below) disposed in the apparatus main body 2 with an operator's manual operation. When the button 16 is pressed, a print-receiving medium with print 109 (details are described below) is cut and the cut print-receiving medium with print 109 is separated away from the apparatus main body 2 as the printed matter.

The opening and closing lid 3 is rotatably, axially supported at an edge portion on the right deep side of the apparatus main body 2 in FIG. 1 and always urged in an opening direction via an urging member such as a spring. An opening and closing button 4 is pressed that is disposed adjacent to the opening and closing lid 3 on the top face of the apparatus main body 2 to release a lock between the opening and closing lid 3 and the apparatus main body 2, which is accordingly opened with an effect of the above described urging member. At a center side portion of the opening and closing lid 3, a transparent window 5 covered with a transparent cover is provided.

<Internal Unit>

Figure 2:
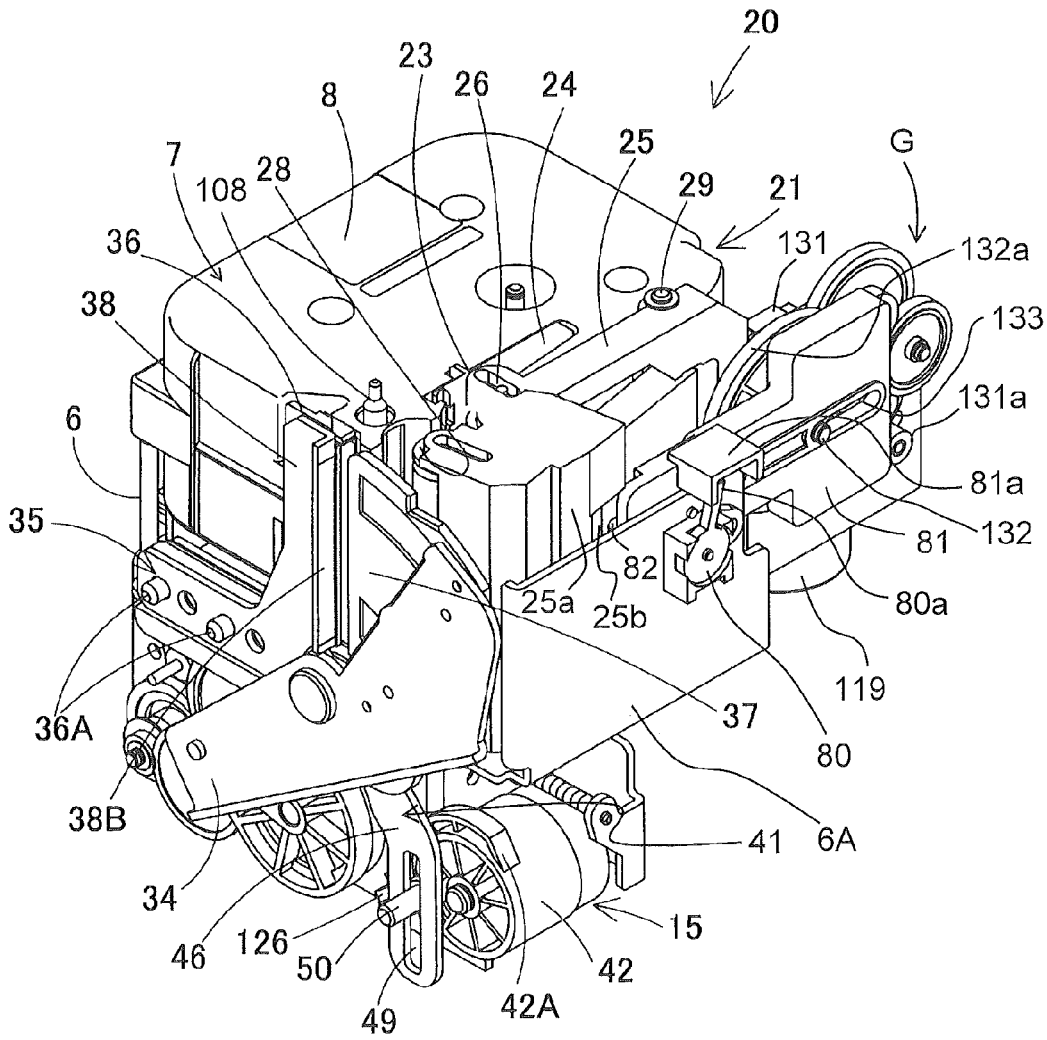
FIG. 2 is a perspective view illustrating a structure of an internal unit inside the printer with a printed matter discharging mechanism removed.
Figure 3:
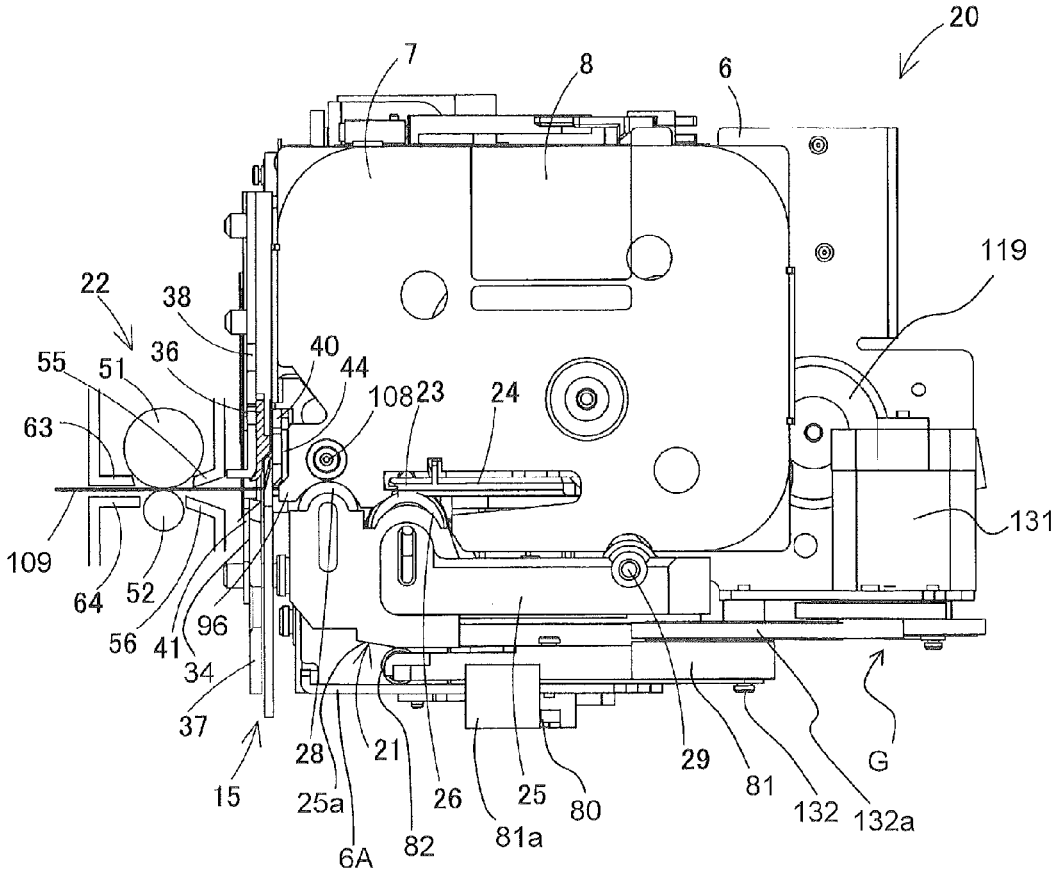
FIG. 3 is a plan view illustrating a structure of the internal unit.

A structure of an internal unit 20 inside the printer 1 will be described below. As illustrated in FIGS. 2, 3, schematically, the internal unit 20 includes a cartridge holder 6 storing a cartridge 7, a printing mechanism 21 including a thermal head 23, a cutting mechanism 15, a half-cut unit 35 including a half cutter 34, and a printed matter discharging mechanism 22 discharging the created printed matter via the printed matter discharging exit 11 (refer to FIG. 1).

<Cartridge Holder and Cartridge>

The cartridge holder 6 stores the cartridge 7 such that the direction in a width direction of the print-receiving medium with print 109 moving toward the printed matter discharging exit 11 is in a vertical direction. At one place of an inner peripheral wall of the cartridge holder 6, a plurality of detection rods that is included in a cartridge sensor 100 (refer to FIG. 6 described below) and can freely advance and retreat is erected. The cartridge sensor 100 can detect a type of the cartridge 7 (i.e., attribute of the print-receiving medium such as whether a print-receiving medium 101 has a tubular shape or a tape-like shape, and further what is a dimension in the width direction) mounted in the cartridge holder 6 according to a combination between on and off acquired by insertion of the detection rods into a plurality of detection holes in a to-be detected portion provided on one place of an outer peripheral wall of the cartridge 7, when the cartridge 7 is mounted into the cartridge holder 6, and can output a corresponding signal.

Figure 4:
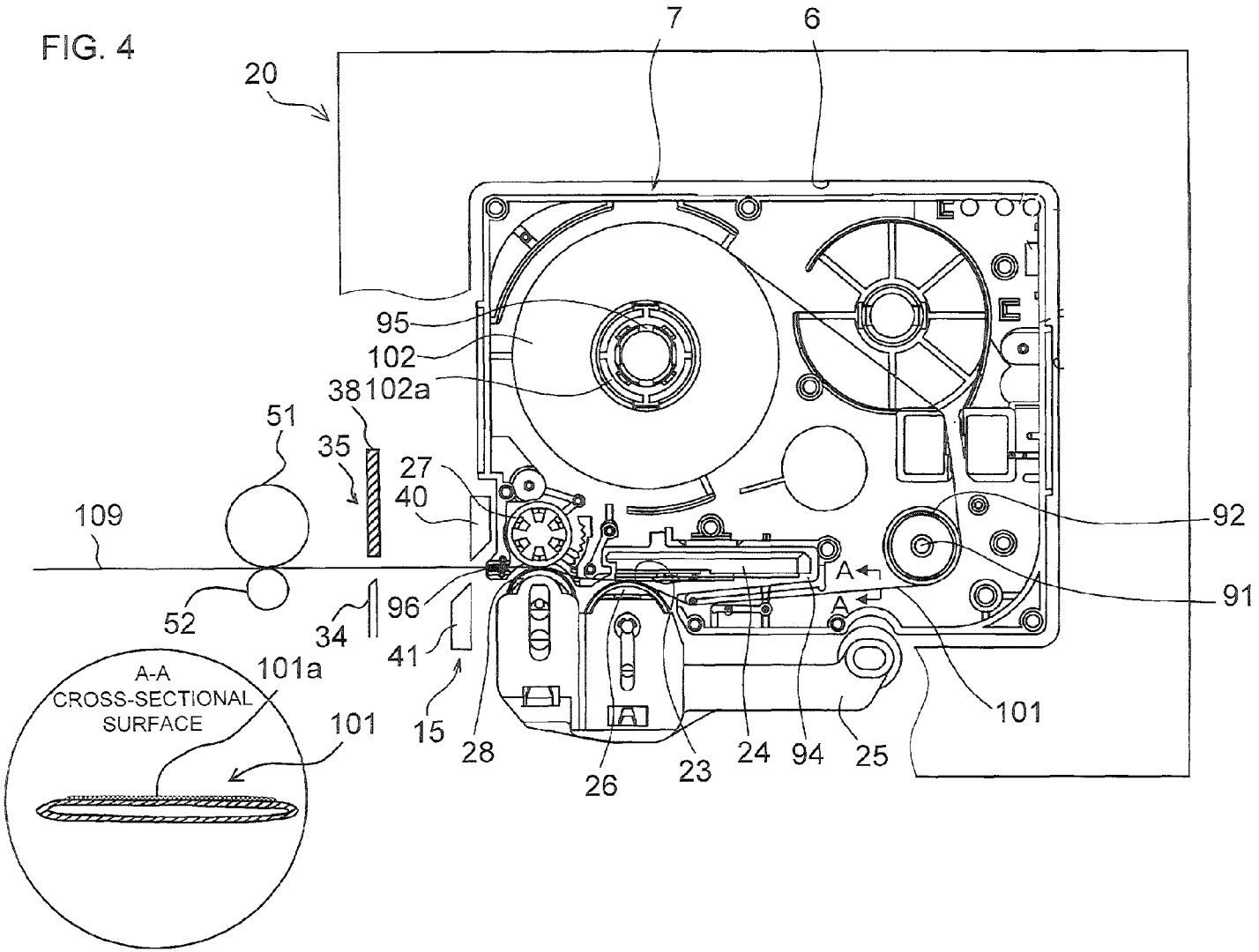
FIG. 4 is an enlarged plan view schematically illustrating a detailed structure of a cartridge.

With reference to FIGS. 3, 4, a detailed structure of the cartridge 7 will be described below. According to the present embodiment, the cartridge 7 includes a tube cartridge supplying a print-receiving tube in a flat tubular shape as the print-receiving medium 101 and a tape cartridge supplying a print-receiving tape in a tape-like shape as the print-receiving medium 101. The tube cartridge of the cartridge 7 is mainly described as an example, a tape cartridge also has a similar structure in other parts than the shape of the print-receiving medium 101 as described above.

As illustrated in FIGS. 3, 4, the cartridge 7 (corresponding to the tube cartridge in the example as described above) includes a print-receiving medium roll 102 around which the print-receiving medium 101 is wound, and a sending roller 27 by which the print-receiving medium 101 is fed to an outside direction of the cartridge 7.

The sending roller 27 is driven to rotate interlocking with transmission of a drive force of a feeding motor 119 (refer to FIG. 3 and the above described FIG. 2) that is a pulse motor, for example, provided outside the cartridge 7, to a sending roller driving shaft 108 (refer to FIGS. 2, 3) via a gear mechanism (not illustrated).

The print-receiving medium roll 102 winds the above described print-receiving medium 101 around a reel member 102*a* (in a flat tubular shape, in the example). The reel member 102*a* is stored by being rotatably fitted and inserted into a boss 95 erected on a bottom face of the cartridge 7.

In the example, as illustrated in an enlarged diagram of an A-A cross-sectional surface in FIG. 4, the print-receiving medium 101 is a print-receiving tube on one surface of which a heat-sensitive layer 101*a* generating color with heat is formed. The print-receiving medium 101 is wound around the reel member 102*a*, with a surface formed with the heat-sensitive layer 101*a* set as an inner peripheral side, to form the print-receiving medium roll 102. An image receiving layer including a transparent coat layer of a print-receiving material, for example, is provided in place of the heat-sensitive layer 101*a*, and the image receiving layer may be layered with an ink ribbon included in the cartridge 7 to form the print by thermal transfer of ink.

When the cartridge 7 is the above described tape cartridge (not illustrated), as the print-receiving medium 101, the print-receiving tape is included that has a heat-sensitive layer generating color with heat in a similar manner to the above described heat-sensitive layer 101*a* on a surface on one side which is an inner peripheral side. The print-receiving tape has, for example, a three-layered structure in which a film including PET (polyethylene terephthalate) having the heat-sensitive layer, an adhesive layer including an appropriate material, and a separation sheet are sequentially layered.

On a top face of the cartridge 7, a print-receiving medium specification display unit 8, for example, for displaying a width and the like of the above described print-receiving medium 101 built in the cartridge 7 is provided.

<Head Mounting Portion and Roller Holder>

On the other hand, the above described thermal head 23 including a great number of heating elements is mounted in a head mounting portion 24 erected in the cartridge holder 6, and disposed on an upstream side of the sending roller 27 of the sending roller driving shaft 108 in the transport direction.

Further, at a front (lower side in FIG. 3) of the cartridge 7 in the cartridge holder 6, a roller holder 25 is rotatably, pivotally supported by a support shaft 29. A platen roller 26 and a pressure roller 28 are rotatably disposed on the roller holder 25. A state can be switched between a pressing state (state illustrated in FIGS. 3, 4) where, when the roller holder 25 is pressed to a side of the thermal head 23, the platen roller 26 presses the print-receiving medium 101 to the thermal head 23 with the predetermined pressing force, and a separation state (state illustrated in FIG. 2) where, when the roller holder 25 is returned to an opposite side of the side of the thermal head 23, the platen roller 26 is separated away from the print-receiving medium 101.

The above described switch of the roller holder 25 will be described with reference to FIGS. 2, 3, 4. The cartridge holder 6 includes a release motor 131, a release-rod holding plate 81, a release rod 82, and a crank gear mechanism G so that, when the cartridge 7 is mounted, the roller holder 25 can be selectively switched between the above described pressing state and the above described separation state.

In other words, a drive output gear 131*a* of the release motor 131 is operably connected to a cam gear 132*a* provided on a cam shaft 132 via the crank gear mechanism G. The cam shaft 132 is inserted into and disposed in a crank shaft hole 133 of the release-rod holding plate 81. With this arrangement, when the release motor 131 is rotated in one direction to transmit its drive force to the cam gear 132*a* and then the cam shaft 132 is rotated in a corresponding direction, the release-rod holding plate 81 moves forward to a side of a cutting mechanism 15. Further, when the release motor 131 is rotated in the other direction opposite to the above described one direction to transmit its drive force to the cam gear 132*a* and then the cam shaft 132 is rotated in a corresponding direction, the release-rod holding plate 81 moves backward so as to separate away from the cutting mechanism 15.

Figure 5A:
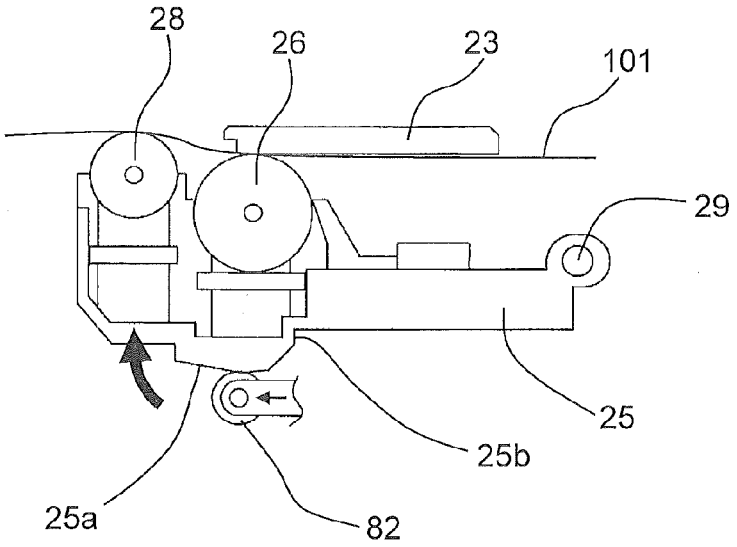
FIG. 5A is a plan view illustrating a behavior of a release rod in an advance movement.
Figure 5B:
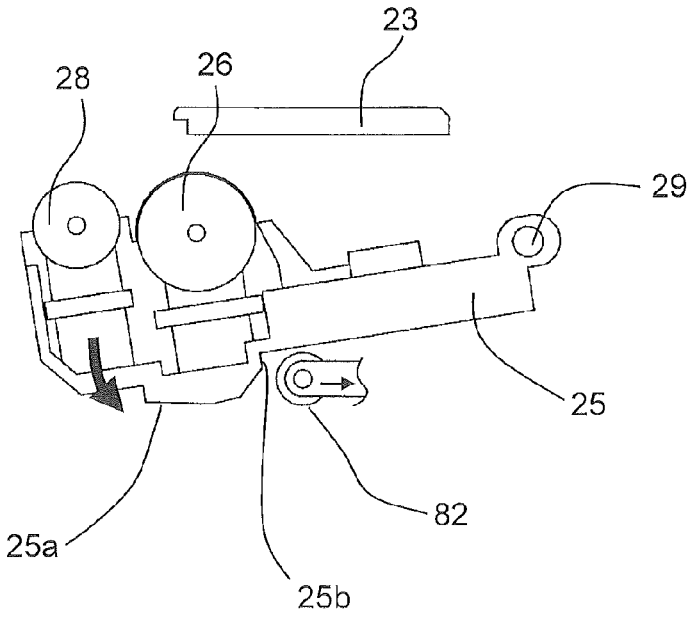
FIG. 5B is a plan view illustrating a behavior of the release rod in a retreat movement.

At this point, as illustrated in FIGS. 2, 3 and 5, on an tip end of the release-rod holding plate 81 on the cutting mechanism 15 side, the above described release rod 82 in a roller shape is provided. When the release-rod holding plate 81 moves forward due to the above described rotational drive of the release motor 131 in one direction, (refer to a thin arrow in FIG. 5A), the release rod 82 also moves forward to abut on an inclined face 25*a* from a side of a step portion 25*b* of the roller holder 25 so as to run on the inclined face 25*a*. With this arrangement, the roller holder 25 rotates about the support shaft 29 (refer to a thick arrow in FIG. 5A) so that the platen roller 26 is pressed against the side of the thermal head 23 (above described pressing state). On the other hand, when the release-rod holding plate 81 moves backward due to the above described rotational drive of the release motor 131 in the other direction from the pressing state (refer to a thin arrow in FIG. 5B), the release rod 82 also moves backward from an edge portion of the above described inclined face 25*a* to the step portion 25*b* side, and then the release rod 82 is released from abutting on the inclined face 25*a*. With this arrangement, the roller holder 25 rotates about the support shaft 29 in a direction opposite to the above described direction (refer to a thick arrow in FIG. 5B) to separate the platen roller 26 away from the thermal head 23 side (above described separation state).

At this point, on an upper edge portion of the release-rod holding plate 81, a downward U-shaped frame-like engagement portion 81*a* is provided. Further, corresponding to the engagement portion 81*a*, a rotatable position detecting sensor 80 is provided on a support wall 6A which is provided on the cartridge holder 6 so as to cover an outside of the release-rod holding plate 81. A protruded operation part 80*a* is projected on one edge side of the position detecting sensor 80 and engaged into the U-shaped frame of the above described engagement portion 81*a*. With this arrangement, as described above, along with the advance and retreat movement of the release-rod holding plate 81 by the drive of the release motor 131, the operation part 80*a* is slid right and left by the engagement part 81*a*. As a result, the position detecting sensor 80, by detecting in which direction the operation part 80*a* is slid with an appropriate method, can detect the positions of the release-rod holding plate Bland the release rod 82, in other words, whether the above described roller holder is in the above described pressing state or the above described separation state.

As described above, in place of the configuration in which the platen roller 26 gets closer to or separates away from the thermal head 23 by the rotation of the roller holder 25, a configuration may be adopted in which the position of the platen roller 26 is fixed and the thermal head 23 gets closer to or separates away from the platen roller 26.

<Feeding Operation of Print-Receiving Medium in Cartridge>

In the above described configuration, when the cartridge 7 is mounted in the cartridge holder 6 and the roller holder 25 is moved from the separation position to the abutting position as described above, the print-receiving medium 101 is held between the thermal head 23 and the platen roller 26 and further between the sending roller 27 and the pressure roller 28.

The sending roller driving shaft 108 is driven to rotate with the drive force of the feeding motor 119. At this point, the above described sending roller driving shaft 108, the above described pressure roller 28, and the platen roller 26 are connected with one another via a gear mechanism (not illustrated), and thus along with the drive of the sending roller driving shaft 108, the sending roller 27, the pressure roller 28, and the platen roller 26 are rotated in synchronization. With this arrangement, the print-receiving medium 101 is fed out from the print-receiving medium roll 102.

The fed out print-receiving medium 101 is guided, as illustrated in FIG. 4, by a reel 92 in a substantially cylindrical shape rotatably fitted and inserted into a reel boss 91 erected on a bottom face of the cartridge, fed to a downstream side from an opening portion 94 in the transport direction, and then supplied to the thermal head 23. At this point, a plurality of heating elements of the thermal head 23 is energized by a print-head driving circuit 120 (refer to FIG. 6 described below). With this arrangement, the above described heat-sensitive layer 101*a* of the print-receiving medium 101 generates the color, and thus the desired print is printed on the surface thereof. The print-receiving medium 101 with print on which the printing has been ended is held between the above described sending roller 27 and the pressure roller 28, and then fed out of the cartridge 7 via a print-receiving medium discharging exit 96 as the print-receiving medium with print 109. Subsequently, the print-receiving medium with print 109 is fed by a discharging roller 51 and cut by the cutting mechanism 15 (details will be described below).

<Cutting Mechanism>

The cutting mechanism 15 cuts the print-receiving medium 101 in a thickness direction to divide it. In other words, when the print-receiving medium 101 is the print-receiving tube, the print-receiving medium 101 is cut over whole circumference. When the print-receiving medium 101 is the print-receiving tape or the like, whole layers of the print-receiving medium 101 are cut. With this arrangement, the printed matter including the above described print (tube with print or print label) is produced. As illustrated in FIGS. 2, 3 and 4, the cutting mechanism 15 includes a fixed blade 40, a movable blade 41 performing a cutting operation with the fixed blade 40, a cutter-helical gear 42 (refer to FIG. 2) connected to the movable blade 41, and a cutter motor 43 (refer to FIG. 6 described below) connected to the cutter-helical gear 42 with a gear row. The cutter-helical gear 42 includes a boss 50 formed in a protruded shape, and the boss 50 is inserted into a long hole 49 of the movable blade 41 (refer to FIG. 2).

The fixed blade 40 is fixed with a screw or the like via a fixed hole to a side plate 44 (refer to FIG. 3) provided in a standing state on a side portion of the cartridge holder 6. The movable blade 41 is formed in a substantially V-like shape, and the above described long hole 49 is formed in a handle portion 46 at an opposite side of a blade portion (not illustrated) provided on a cutting portion of the movable blade 41.

When the cutter-helical gear 42 is rotated by the cutter motor 43, the movable blade 41 is slid due to the engagement between the boss 50 and the long hole 49 to cut the print-receiving medium with print 109. In the above described state, a cam 42A for the cutter-helical gear is provided on a cylindrical outer wall of the cutter-helical gear 42. When the cutter-helical gear 42 is rotated by the above described cutter motor 43, a micro switch 126 (refer to FIG. 2) provided adjacent to the cutter-helical gear 42 is switched from an off state to an on state due to an operation of the cam 42A for the cutter-helical gear, and thus a cutting state of the print-receiving medium with print 109 is detected.

<Half Cut Unit>

A detailed configuration of the half-cut unit 35 will be described. The half-cut unit 35 performs cutting when the above described tape cartridge including the print-receiving medium 101, which is the above described print-receiving tube, is mounted as the cartridge 7. The print-receiving tape includes a plurality of layers (e.g., a film as a base material, the adhesive layer including adhesive, and the separation sheet as a separation material). While the half-cut unit 35 leaves a part of the above described layers, it cuts other layers (partial cutting). The half-cut unit 35 is mounted to be located on a downstream side of the fixed blade 40 and the movable blade 41 in the transport direction of the print-receiving medium with print 109 (in the example, the print-receiving tape with print) between the fixed blade 40 and the movable blade 41 and between first guiding walls 55 and 56 (refer to FIG. 3).

As illustrated in FIG. 2, the half-cut unit 35 includes a receiving base 38 disposed on a side of the fixed blade 40 from a feeding path of the print-receiving medium with print 109, a half cutter 34 disposed so as to face the receiving base 38, a first-guiding part 36 disposed aligned with the fixed blade 40 between the fixed blade 40 and the receiving base 38, and a second-guiding part 37 disposed facing the first-guiding part 36.

The first-guiding part 36 and the second-guiding part 37 are integrally formed and mounted on the side plate 44 (refer to FIG. 3) with the fixed blade 40 by a guide fixing portion 36A (refer to FIG. 2) provided on a position corresponding to a fixing hole of the fixed blade 40.

The receiving base 38 is located on an opposite side of the above described half cutter 34 with the feeding path of the print-receiving medium with print 109 therebetween, and includes a receiving face 38B receiving the half cutter 34.

Further, to rotate the half cutter 34 about a predetermined rotation fulcrum (not illustrated), a half-cutter motor 129 (refer to FIG. 6 described below) is provided. The rotational drive force is transmitted to the half cutter 34 in a predetermined direction from the half-cutter motor 129 so that the half cutter 34 can be rotated in a predetermined direction (clockwise direction or counterclockwise direction).

In the above described configuration, using the drive force of the above described half-cutter motor 129, the above described half cutter 34 is pressed onto the receiving face 38A. With this arrangement, the print-receiving medium with print 109 located between the half cutter 34 and the receiving face 38A is partially cut (half-cut) in the thickness direction as described above to form a half-cut line substantially in the width direction of a print-receiving medium.

<Printed Matter Discharging Mechanism>

The printed matter discharging mechanism 22 forcibly discharges the print-receiving medium with print 109 (i.e., a tube with print, a print label, and the same hereinafter) that has been cut by the cutting mechanism 15 via the printed matter discharging exit 11. In other words, the printed matter discharging mechanism 22 includes the discharging roller 51 driven by a printed matter discharging motor 65 (refer to FIG. 6 described below) and a pressing roller 52 facing the discharging roller 51 with the print-receiving medium with print 109 therebetween.

The above described first guiding walls 55, 56 and second guiding walls 63, 64 for guiding the print-receiving medium with print 109 to the printed matter discharging exit 11 in the state described above are provided inside the above described printed matter discharging exit 11 (refer to FIG. 3). Each of the first guiding walls 55, 56 and the second guiding walls 63, 64 are integrally formed and disposed to be spaced away from each other with a predetermined distance at a discharge position of the print-receiving medium with print 109 that has been cut with the above described fixed blade 40 and movable blade 41.

<Control System>

Figure 6:
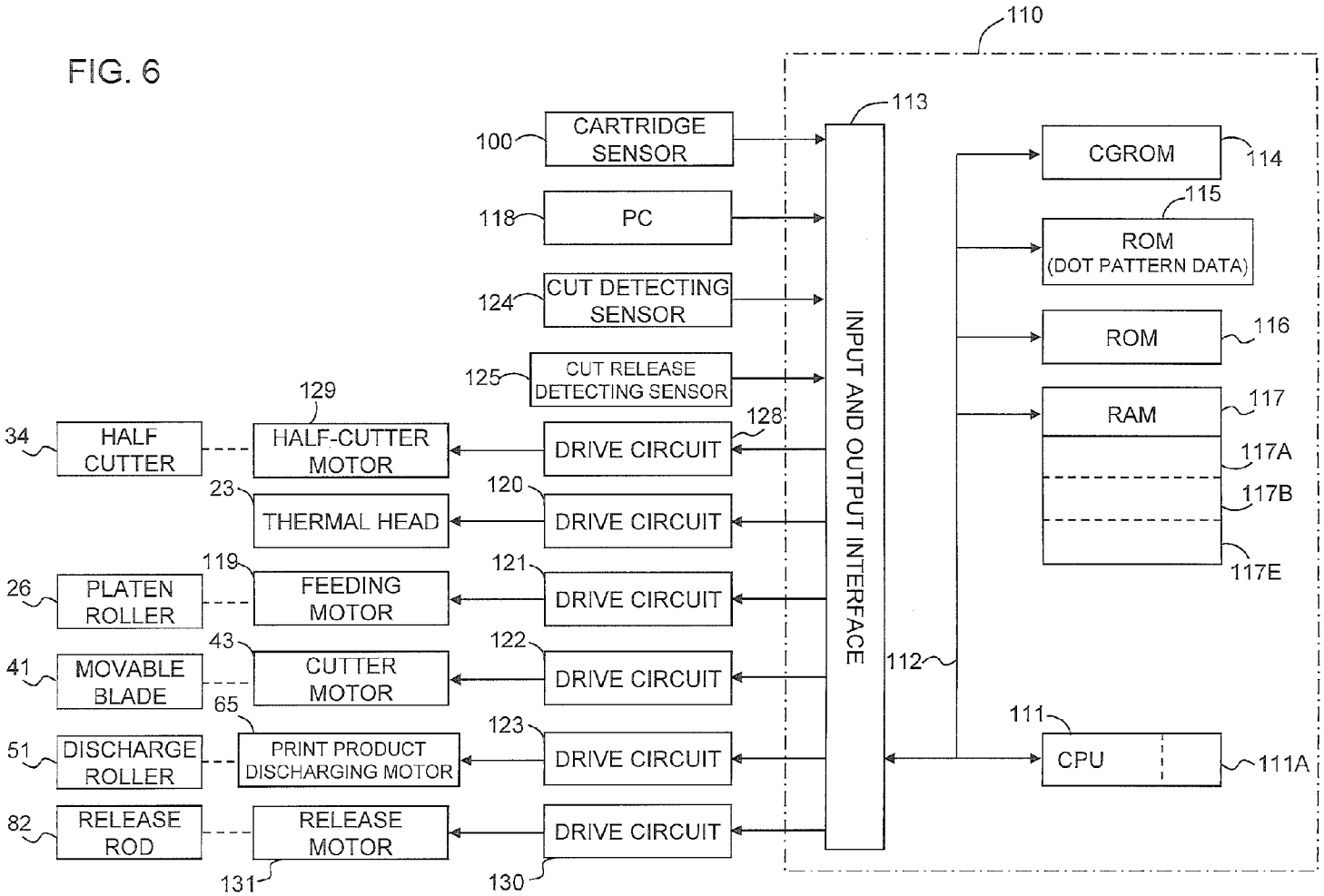
FIG. 6 is a functional block diagram illustrating a functional configuration of a control system of the printer.

With reference to FIG. 6, the control system of the printer 1 will be described. As illustrated in FIG. 6, on a control substrate (not illustrated) of the printer 1, a control circuit 110 is disposed.

The control circuit 110 includes a CPU 111 including a timer 111A therein and controlling each device, an input and output interface 113 connected with the CPU 111 via a data bus 112, a CGROM 114, ROMs 115, 116, and a RAM 117. The input and output interface 113 is connected with the PC 118 as the above described operation terminal.

The CGROM 114 stores, for example, dot-pattern data about each of a great number of characters in correspondence to code data. In the ROM (dot-pattern memory) 115, the print dot-pattern data is classified for each font (Gothic font, Mincho font, and so on) about each of the great number of characters for printing characters such as alphabet characters and symbols, and the print dot-pattern data in an amount of print character size for each font is stored in correspondence to code data. Further, graphic-pattern data for printing a graphic image including gradation expression is also stored. The dot-pattern data for the display and print stored in the above described CGROM 114 and ROM 115 can be read from a side of the above described PC 118 via the above described communication line, and the data may be displayed or printed on the PC 118 side that has received the data.

The ROM 116 stores a print drive control program for reading data of a print buffer in correspondence to the code data of the character such as characters and figures input from the above described PC 118, and driving the above described thermal head 23, feeding motor 119 and the like, a pulse number determination program for determining the number of pulses corresponding to an amount of energy for forming each print dot, a cutting drive control program for, when printing is ended, driving the feeding motor 119 to feed the print-receiving medium with print 109 to a cutting position, and then cutting the print-receiving medium with print 109, a printed matter discharging program for forcibly discharging the cut print-receiving medium with print 109 (=tube with print, print label) via the printed matter discharging exit 11, and various types of programs required by the printer 1 to perform other control. Based on various types of programs stored in such a ROM 116, the CPU 111 performs various types of calculations.

The RAM 117 includes a text memory 117A, a print buffer 117B, and a parameter storage area 117E. The text memory 117A stores document data input from the PC 118. The print buffer 117B stores the print dot-pattern including a plurality of characters and symbols as the dot-pattern data, and the thermal head 23 performs dot printing according to the dot-pattern data stored in the print buffer 117B. The parameter storage area 117E stores various types of calculation data.

Further, the input and output interface 113 is connected with the above described cartridge sensor 100, the above described print-head driving circuit 120 for controlling the energization of the thermal head 23, a feeding motor driving circuit 121 for driving the feeding motor 119, a cutter motor driving circuit 122 for driving the above described cutter motor 43, a half-cutter motor driving circuit 128 for driving the above described half-cutter motor 129, a printed matter discharging motor driving circuit 123 for driving the above described printed matter discharging motor 65, a cut detecting sensor 124 for detecting that the print-receiving medium with print 109 has been cut, a cut release detecting sensor 125, and a release motor driving circuit 130 for driving the above described release motor 131.

In a control system including such the control circuit 110 as a core, when the character data or the like is input via the PC 118, the text (document data) is sequentially stored in the text memory 117A, and the thermal head 23 is driven via the driving circuit 120 so that each heating element is selectively driven to heat corresponding to the print dot for one line to print the dot-pattern data stored in the print buffer 117B. In synchronization with the printing, the feeding motor 119 is driven via the feeding motor driving circuit 121 to feed the print-receiving medium 101 and the print-receiving medium with print 109. When the printing of the above described dot-pattern data is ended, feeding of the print-receiving medium with print 109 is stopped. The cutter motor 43 is driven via the cutter-motor driving circuit 122 to cut the print-receiving medium with print 109 by the cutting mechanism 15. Subsequently, the printed matter discharging motor 65 is driven via the printed matter discharging motor driving circuit 123 to discharge the cut print-receiving medium with print 109 (tube with print, print label) outside the apparatus.

<Features of First Embodiment>

When the above described tube cartridge is used as the cartridge 7 (appropriately denoted as "tube cartridge 7" hereinafter), since the print-receiving medium 101 has a tubular shape as described above, as the tube with print is sequentially produced as described above, the air inside the tube is moved to the upstream side of a position of the platen roller 26 in the transport direction so that the air is easily accumulated inside the tube-shaped structure, and the air once accumulated therein is hardly removed. As a result, the tube-shaped structure is expanded with the accumulated air, which may cause the feeding failure of the print-receiving medium 101 inside the tube cartridge 7.

In the present embodiment, when the printing processing is sequentially performed for a certain period on the tubular print-receiving medium 101 with the tube cartridge 7 mounted, the roller holder 25 is driven to switch from the above described pressing state where the platen roller 26 presses the print-receiving medium 101 to the thermal head 23, to the above described separation state where the platen roller 26 separates away from the print-receiving medium 101.

<Control Steps>

Figure 7:
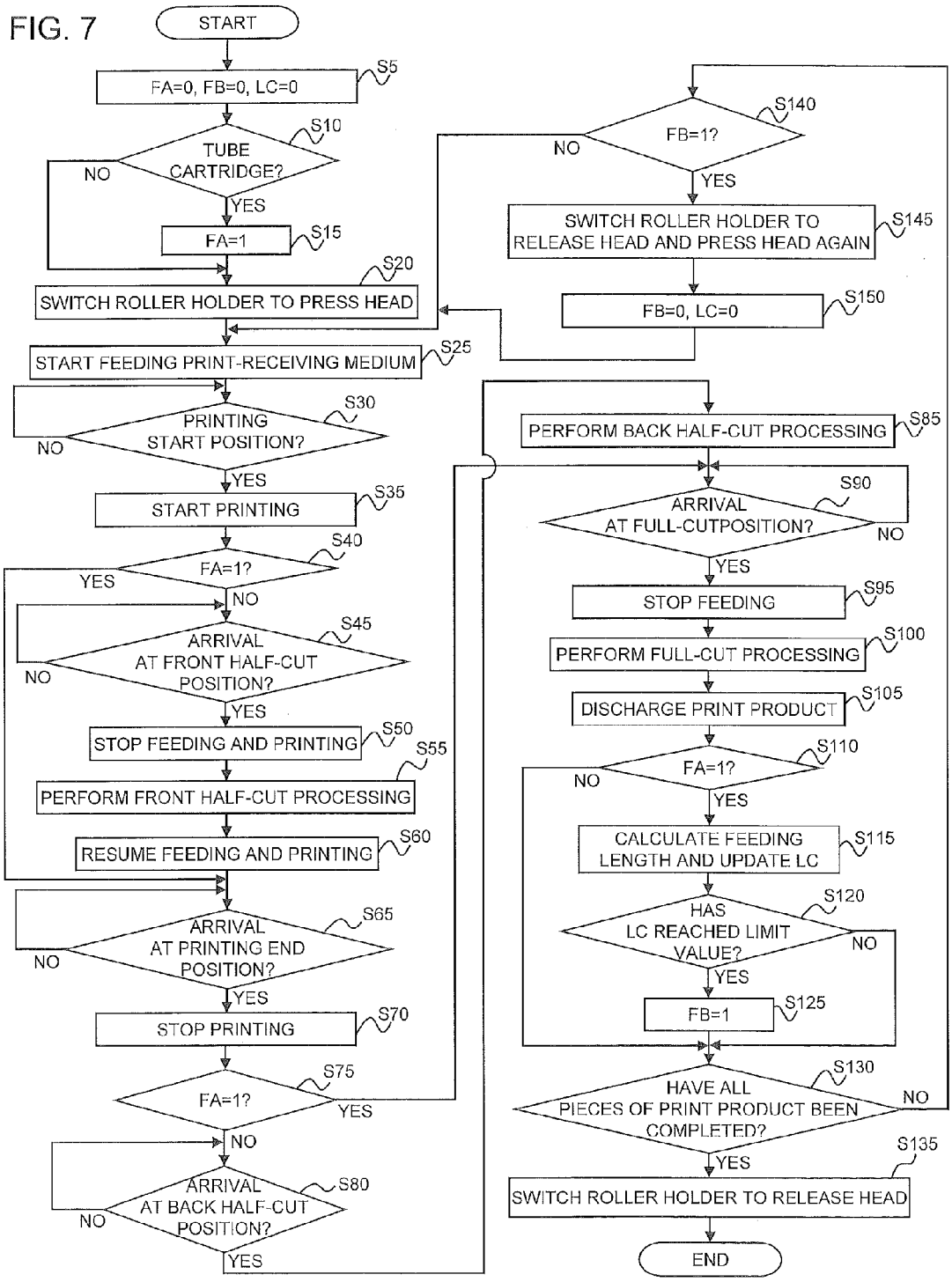
FIG. 7 is a flowchart illustrating control steps executed by a CPU of the control system.

With reference to FIG. 7, the control steps executed by the above described CPU 111, including switching from the above described pressing state to the separation state will be described. A flow in FIG. 7 is started, for example, by appropriately operating the PC 118 to perform a desired printed matter production instruction after the user turns on the power of the printer 1 (or, after the cartridge 7 is exchanged with the power kept on).

In FIG. 7, in step S5, the CPU 111 resets both a tube cartridge flag FA and a feeding-length limit flag FB to "0" and further resets a feeding-length accumulation value LC to "00". The tube cartridge flag FA represents that the cartridge 7 is the tube cartridge, and the feeding-length limit flag FB represents that the accumulation value of the feeding lengths of the print-receiving medium 101 by the platen roller 26 has reached a limit value (details will be described below). When step S5 is ended, the processing proceeds to step S10.

In step S10, the CPU 111 determines whether or not the cartridge 7 mounted in the cartridge holder 6 is the above described tube cartridge, based on a detection result of the above described cartridge sensor 100. As described above, when the user mounts the cartridge 7 into the cartridge holder 6, the cartridge sensor 100 detects a type of the mounted cartridge 7 (i.e., attribute of the print-receiving medium 101). When the cartridge sensor 100 detects that the mounted cartridge 7 is the tube cartridge supplying the above described print-receiving tube, a determination is satisfied (YES, in step S10) and the processing proceeds to step S15. When the cartridge sensor 100 detects that the mounted cartridge 7 is the tape cartridge supplying the print-receiving tape, the determination is not satisfied (NO, in step S10) and the processing proceeds to step S20 described below.

In step S15, the CPU 111 proceeds to step S20 with the flag FA set to FA=1.

In step S20, the CPU 111 outputs a control signal to the release-motor driving circuit 130 via the input and output interface 113, and moves forward the release rod 82 and the release-rod holding plate 81 by the drive of the release motor 131. With this arrangement, the above described pressing state is set where the platen roller 26 of the roller holder 25 presses the print-receiving medium 101 to the thermal head 23 with the predetermined pressing force so that the print-receiving medium 101 is held between the platen roller 26 and the thermal head 23 (refer to the above described FIG. 5A). When step S20 is ended, the processing proceeds to step S25.

In step S25, the CPU 111 outputs the control signal to the feeding motor driving circuit 121 via the input and output interface 113, and rotationally drives the sending roller 27 and the platen roller 26 with the drive force of the feeding motor 119. Further, the CPU 111 outputs the control signal to the above described printed matter discharging motor 65 via the printed matter discharging motor driving circuit 123 to rotationally drive the discharging roller 51. With this arrangement, the print-receiving medium 101 is fed out from the print-receiving medium roll 102 and fed. Subsequently, the processing proceeds to step S30.

In step S30, the CPU 111 determines whether or not the print-receiving medium 101 has arrived at a printing start position by the thermal head 23 (i.e., whether or not the print-receiving medium 101 has been fed to a position where the thermal head 23 faces a front edge position of the print area of the print-receiving medium 101 in the transport direction). The determination can be acquired by determining, for example, whether the print-receiving medium has been fed by a predetermined distance since start of feeding the print-receiving medium in step S25. The determination on the predetermined distance can be made, for example, by counting the number of pulses output by the feeding motor driving circuit 121 driving the feeding motor 119, which is the pulse motor, after the timing in the above described step S25, and determining whether the number of counts has reached a predetermined value corresponding to the above described predetermined distance. Alternatively, it may be determined whether a predetermined time has elapsed since the above described tape feeding start. Until the print-receiving medium 101 arrives at the printing start position, the determination is not satisfied (NO, in step S30), and the processing waits in a loop. When it has arrived at the printing start position, the determination is satisfied (YES in step S30), and the processing proceeds to step S35.

In step S35, the CPU 111 outputs the control signal to the print-head driving circuit 120 via the input and output interface 113 to energize the thermal head 23. With this arrangement, the heat-sensitive layer 101*a* of the print-receiving medium 101 generates the color, and in the above described print area, printing of a desired print such as a character, a symbol, and a barcode corresponding to the desired print data that has been previously created is started. Subsequently, the processing proceeds to step S40.

In step S40, the CPU 111 determines whether or not the above described tube cartridge flag FA indicates FA=1. When the cartridge 7 mounted in the cartridge holder 6 is the tube cartridge, and FA=1 is indicated (refer to step S15), the determination is satisfied (YES, in step S40), and the processing proceeds to step S65 described below.

On the other hand, in step S40, when the mounted cartridge 7 is the tape cartridge, and FA=0 is indicated, the determination is not satisfied (NO, in step S40), and the processing proceeds to step S45. In step S45, the CPU 111 determines whether or not the print-receiving medium 101 (i.e., in this case, the print-receiving tape) has been fed to a front half-cut position that has been previously set (i.e., whether or not the print-receiving medium with print 109 has arrived at the position where the half cutter 34 of the half-cut unit 35 faces the above described front half-cut position). In a similar manner as described above, the determination may be also made by counting the number of the pulses for driving the feeding motor 119. Until the print-receiving medium 101 arrives at the front half-cut position, the determination is not satisfied (NO, in step S45), and the processing repeats the steps described above. When the print-receiving medium 101 has arrived at the front half-cut position, the determination is satisfied (YES, in step S45), and the processing proceeds to step S50.

In step S50, the CPU 111 outputs the control signal to the feeding motor driving circuit 121 and the printed matter discharging motor driving circuit 123 via the input and output interface 113 to stop driving the feeding motor 119 and the printed matter discharging motor 65, and accordingly stop rotation of the platen roller 26, the sending roller 27, the discharging roller 51 and the like. With this arrangement, with the half cutter 34 facing the position of the above described front half-cut position, feeding-out of the print-receiving medium 101 (print-receiving tape) from the print-receiving medium roll 102 and feeding of the print-receiving medium with print 109 (print-receiving tape with print) are stopped. At this point, the CPU 111 also outputs the control signal to the print-head driving circuit 120 via the input and output interface 113 to stop energizing the thermal head 23 and performing printing described above. Subsequently, the processing proceeds to step S55.

In step S55, the CPU 111 performs front half-cut processing for outputting the control signal to the half-cutter motor driving circuit 128 via the input and output interface 113 to drive the half-cutter motor 129, rotating the half cutter 34 to partially cut the print-receiving medium with print 109 in the thickness direction, and forming a front half-cut line. When step S55 is ended, the processing proceeds to step S60.

In step S60, in a similar manner to the above described step S25, the CPU 111 rotationally drives the platen roller 26, the sending roller 27, the discharging roller 51 and the like to resume feeding the print-receiving medium with print 109, and in a similar manner to step S35, the CPU 111 energizes the thermal head 23 to resume performing the printing. Subsequently, the processing proceeds to step S65.

In step S65 to which the processing has proceeded from the above described step S40 or the above described step S60, the CPU 111 determines whether or not the print-receiving medium 101 has arrived at a printing end position by the thermal head 23 (i.e., whether or not the print-receiving medium 101 has been fed to a position where the thermal head 23 faces a back edge position of the above described print area in the transport direction). In a similar manner as described above, the determination may be also made by counting the number of pulses for driving the feeding motor 119. Until the print-receiving medium 101 arrives at the printing end position, the determination is not satisfied (NO, in step S65), and the steps are repeated. When the print-receiving medium 101 has arrived at the printing end position, the determination is satisfied (YES, in step S65), and the processing proceeds to step S70.

In step S70, in a similar manner to the above described step S50, the CPU 111 stops energizing the thermal head 23 to stop printing the above described desired print. With this arrangement, printing the desired print in the print area of the print-receiving medium 101 is completed. Subsequently, the processing proceeds to step S75.

In step S75, in a similar manner to the above described step S40, the CPU 111 determines whether or not the tube cartridge flag FA indicates FA=1. When the flag FA=1 is indicated (when the tube cartridge is mounted in the cartridge holder 6), the determination is satisfied (YES, in step S75), and the processing proceeds to step S90 described below.

On the other hand, in the above described step S75, when the flag FA=0 is indicated (when the tape cartridge is mounted in the cartridge holder 6), the determination is not satisfied (NO, in step S75), and the processing proceeds to step S80. In step S80, the CPU 111 determines whether or not the print-receiving medium with print 109 (i.e., print-receiving tape with print) has been fed to a back half-cut position that has been previously set (i.e., whether or not the print-receiving medium with print 109 has arrived at a position where the half cutter 34 of the half-cut unit 35 faces the above described half-cut position). In a similar manner as described above, the determination may be also made by counting the number of the pulses for driving the feeding motor 119. Until the print-receiving medium with print 109 arrives at the back half-cut position, the determination is not satisfied (NO, in step S80), and the steps are repeated. When the print-receiving medium with print 109 has arrived at the back half-cut position, the determination is satisfied (YES, in step S80), and the processing proceeds to step S85.

In step S85, in a similar manner to the above described step S55, the CPU 111 performs back half-cut processing for rotating the half cutter 34 to partially cut the print-receiving medium with print 109 in the thickness direction, and forming a back half-cut line. When step S85 has been ended, the processing proceeds to step S90.

In step S90 to which the processing has proceeded from the above described step S75 or the above described step S85, the CPU 111 determines whether or not the print-receiving medium with print 109 has been fed to a full-cut position (i.e., whether or not the print-receiving medium with print 109 has arrived at a position where the movable blade 41 faces a cut line previously set). In a similar manner as described above, the determination may be also made by counting the number of pulses for driving the feeding motor 119. Until the print-receiving medium with print 109 arrives at the full-cut position, the determination is not satisfied (NO, in step S90), and the steps are repeated. When the print-receiving medium with print 109 has arrived at the full-cut position, the determination is satisfied (YES, in step S90), and the processing proceeds to step S95.

In step S95, in a similar manner to the above described step S50, the CPU 111 stops rotating the platen roller 26, the sending roller 27, the discharging roller 51 and the like to stop feeding the print-receiving medium with print 109. With this arrangement, with the movable blade 41 of the cutting mechanism 15 facing the above described cut line, feeding-out the print-receiving medium 101 from the print-receiving medium roll 102 and feeding the print-receiving medium with print 109 are stopped. Subsequently, the processing proceeds to step S100.

In step S100, the CPU 111 performs full-cut processing for outputting the control signal to the cutter-motor driving circuit 122 to drive the above described cutter motor 43, rotating the movable blade 41 to divide whole layers of the print-receiving medium with print 109 in the thickness direction, and forming the cut line. The printed matter (tube with print when the print-receiving medium 101 is the print-receiving tube, or print label when the print-receiving medium 101 is the print-receiving tape) is produced which is cut off from the print-receiving medium with print 109 by dividing with the cutting mechanism 15 and on which the desired print has been performed. When step S100 is ended, the processing proceeds to step S105.

In step S105, the CPU 111 outputs the control signal to the printed matter discharging motor driving circuit 123 via the input and output interface 113 to resume driving the above described printed matter discharging motor 65 and rotate the discharging roller 51. With this arrangement, feeding the discharging roller 51 is resumed, and the printed matter (tube with print or print label) produced in the above described step S100 is fed to the printed matter discharging exit 11 and discharged outside the printer 1 via the printed matter discharging exit 11. Subsequently, the processing proceeds to step S110.

In step S110, in a similar manner to the above described step S40, the CPU 111 determines whether or not the tube cartridge flag FA indicates FA=1. As already described, when the cartridge 7 mounted in the cartridge holder 6 is the tube cartridge, FA=1 is indicated. When it is the tape cartridge, FA=0 is indicated. When FA=1 is indicated, the determination is satisfied (YES, in step S110), and the processing proceeds to step S115. When FA=0 is indicated, the determination is not satisfied (NO, in step S110), and the processing proceeds to step S130 described below.

In step S115, the CPU 111 calculates the feeding length of the print-receiving medium 101 (i.e., print-receiving tube) fed by the platen roller 23 after the above described step S25 (i.e., since feeding has been started). The feeding length can be calculated by a method, for example, for counting the number of pulses for driving the feeding motor 119 described above. At this point, the CPU 111 accumulates the feeding lengths calculated in step S115 by repetitions described below in each of the repetitions to calculate the accumulation value LC. In other words, the feeding length newly calculated in step S115 is added to the above described accumulation value LC calculated in the step S115 so far to update the accumulation value LC as a new accumulation value LC. When step S115 is ended, the processing proceeds to step S120.

In step S120, the CPU 111 determines whether or not the feeding-length accumulation value LC updated in the above described step S115 has reached a predetermined limit value (e.g., 5 m) of a feeding length. The above described limit value of the feeding length is defined as an upper limit of the feeding length of the print-receiving medium 101 fed by the platen roller 26 from a point of view of determining a feeding operation state of the print-receiving medium 101 causing the above described air movement inside the tube of the tube cartridge 7. When the feeding-length accumulation value LC has reached the limit value, the determination is satisfied (YES, in step S120), and the processing proceeds to step S125. When the feeding-length accumulation value LC has not reached the limit value of the feeding length, the determination is not satisfied (NO, in step S120), and the processing proceeds to step S130 described below.

In step S125, the CPU 111 sets to FB=1 the above described feeding-length limit flag FB representing that the feeding-length accumulation value LC of the print-receiving medium 101 fed by the platen roller 26 has reached the above described limit value, and processing proceeds to step S130.

In step S130, the CPU 111 determines whether or not production of all pieces of the above described printed matter specified by the printed matter production instruction input when the flow has been started as described above has been completed. When production of the all pieces of the printed matter has not been completed, the determination is not satisfied (NO, in step S130), and the processing proceeds to step S140.

In step S140, the CPU 111 determines whether or not the above described feeding-length limit flag FB indicates FB=1. When the feeding-length accumulation value LC of the print-receiving medium 101 has reached the above described limit value, and the flag FB=1 is indicated, the determination is satisfied (YES, in step S140), and the processing proceeds to step S145. When the feeding-length accumulation value LC of the print-receiving medium 101 has not reached the above described limit value, and the flag FB=0 is indicated, the determination is not satisfied (NO, in step S140), and the processing returns to the above described step S25 to repeat the same steps.

In step S145, the CPU 111 outputs the control signal to the release-motor driving circuit 130 via the input and output interface 113 to move backward the release rod 82 and the release-rod holding plate 81 by drive of the release motor 131. With this arrangement, the above described separation state (refer to the above described FIG. 5B) is set where the platen roller 26 of the roller holder 25 is separated away from the print-receiving medium 101, and the print-receiving medium 101 is released from the state of being pressed between the platen roller 26 and the thermal head 23. Further subsequently, the CPU 111 outputs the control signal to the release-motor driving circuit 130 via the input and output interface 113 and, in a similar manner to the above described step S20, moves forward the release rod 82 and the release-rod holding plate 81 by drive of the release motor 131 to set the above described pressing state (refer to the above described FIG. 5A) where the print-receiving medium 101 is pressed to the thermal head 23 with the predetermined pressing force by the platen roller 26. When step S145 is ended, the processing proceeds to step S150.

In step S150, the CPU 111 resets the feeding-length limit flag FB and the feeding-length accumulation value LC to "0". When step S150 is ended, the processing returns to the above described step S25 to repeat the same steps. With this arrangement, until production of the above described all pieces of the printed matter is completed, the above described steps S25-S125 are repeated. When the tube cartridge 31 including the print-receiving tube is used, the above described feeding-length accumulation value LC when the steps are repeated is sequentially updated in step S115. When the feeding-length accumulation value LC to be updated while the steps are repeated has reached the above described limit value, the processing returns from step S130 to step S140 in a state where the above described feeding-length limit flag FB is set to "1" in step S125, and the determination in the above described step S140 is satisfied, and then in step S145, as described above, the above described pressing state so far is switched to the above described separation state, and further again switched to the pressing state. As a result, when the flow is started, of the number of the pieces of the printed matters specified by the above described printed matter production instruction, the tubes with print up to the time point when FB=1 is set in step S125 are produced without being switched from the above described pressing state to separation state to pressing state in step S145. Before the production processing (printing processing) is started on the subsequent number of the pieces of the tubes with print when FB=1 is set in step S125, switching from the above described pressing state to separation state to pressing state in step S145 is performed. After the switching is performed, since the accumulation value LC is reset in step S150, in a similar manner as described above, the above described steps S25-S125 are repeated again on the rest number of the pieces of the tube with print.

On the other hand, in the above described step S130, when production of all pieces of the printed matter has been completed, the determination is satisfied (YES, in step S130), and the processing proceeds to step S135. In step S135, the CPU 111 outputs the control signal to the release-motor driving circuit 130 via the input and output interface 113 and, in a similar manner to the above described step S145, moves backward the release rod 82 and the release-rod holding plate 81 by drive of the release motor 131. With this arrangement, the above described separation state (refer to the above described FIG. 5B) is set where the platen roller 26 of the roller holder 25 is separated away from the print-receiving medium 101, and the print-receiving medium 101 is released from the state of being pressed between the platen roller 26 and the thermal head 23. When step S135 is ended, this flow is ended.

As described above, the feeding lengths of the print-receiving medium 101 fed by the platen roller 26 are accumulated and the above described feeding length accumulation value LC is updated, and it is determined whether or not the accumulation value LC has reached the limit value. However, the present disclosure is not limited to the determination described above. In other words, in place of the above described feeding length, the printing length onto the print-receiving medium 101 (in the transport direction) printed by the thermal head 23 may be accumulated and the accumulation value may be updated, and it may be determined whether or not the accumulation value of the printing lengths has reached a predetermined limit value.

<Effect of First Embodiment>

As described above, in the printer 1 of the present embodiment, the tube cartridge 7 is mounted into the cartridge holder 6 and the tubular print-receiving medium 101 (above described print-receiving tube) is fed, and the desired print is formed on the fed print-receiving medium 101 so that the user can use the print-receiving medium with print as a tube with print.

According to the present embodiment, depending on the feeding operation state of the print-receiving medium 70 directly causing the air movement inside the tube as described above, the roller holder 25 is driven to perform auto-switching processing on the roller holder 25 for removing the above described accumulated air (switching from the above described pressing state where the platen roller 26 presses the print-receiving medium 101 to the thermal head 23 with the predetermined pressing force, to the above described separation state where the platen roller 26 is separated away from the print-receiving medium 101, and then further switching to the above described pressing state).

In other words, when the tube cartridge 7 mounted in the cartridge holder 6 is the tube cartridge, the feeding lengths of the print-receiving medium 101 are accumulated. When the accumulation value reaches the above described limit value, switching from the above described pressing state to separation state to pressing state is performed. As described above, the above described pressing state in the printing processing is once switched to the separation state so that the print-receiving medium 101 is released from the state of being pressed between the platen roller 26 and the thermal head 23. As a result, even if the air is accumulated in the tube-shaped structure as described above, the accumulated air can be removed (auto release) from a tube end to an outside. As a result, expansion of the above described tube-shape structure with the accumulated air is suppressed to suppress occurrence of the feeding failure inside the tube cartridge 7.

According to the present embodiment, particularly, as described above, when steps S25-S130 illustrated in FIG. 7 are repeated to sequentially produce the tube with print, if the accumulation value LC reaches the limit value at a certain time point (refer to the above described step S120), before the subsequent production of the tube with print is started (printing processing), the roller holder 25 is switched from the above described pressing state to the above described separation state, and further from the above described separation state to the above described pressing state (refer to the above described step S145). As described above, the state is switched to the above described separation state before the printing processing is started so that expansion of the tube-shaped structure with the air can be reliably suppressed. As a result, occurrence of the feeding failure inside the tube cartridge 7 can be suppressed.

As described above, after the feeding-length accumulation value LC has reached the limit value first (refer to the above described step S120), the above described accumulation value LC is reset (refer to the above described step S150) and counting is performed again, and the state is switched from the above described pressing state to separation state to pressing state right before the subsequent production of the printed matter each time the feeding-length accumulation value LC reaches the limit value. However, the present disclosure is not limited to the switching described above. In other words, after the feeding-length accumulation value LC has reached the limit value first (without resetting the accumulation value LC as described above), the above switching may be performed each time the printed matter is produced.

Modification Example

The above described first embodiment is not limited to the above described mode, but, various types of modifications can be made without departing from the scope and technical ideas of the present disclosure. Such modification examples will be sequentially described below.

(1-1) When Switching is Performed at Predetermined Timing Before Printing Processing in Operation is Ended.

Unlike the first embodiment, at the predetermined timing before the printing processing in operation is ended, switching from the above described pressing state to separation state to pressing state may be performed.

Figure 8:
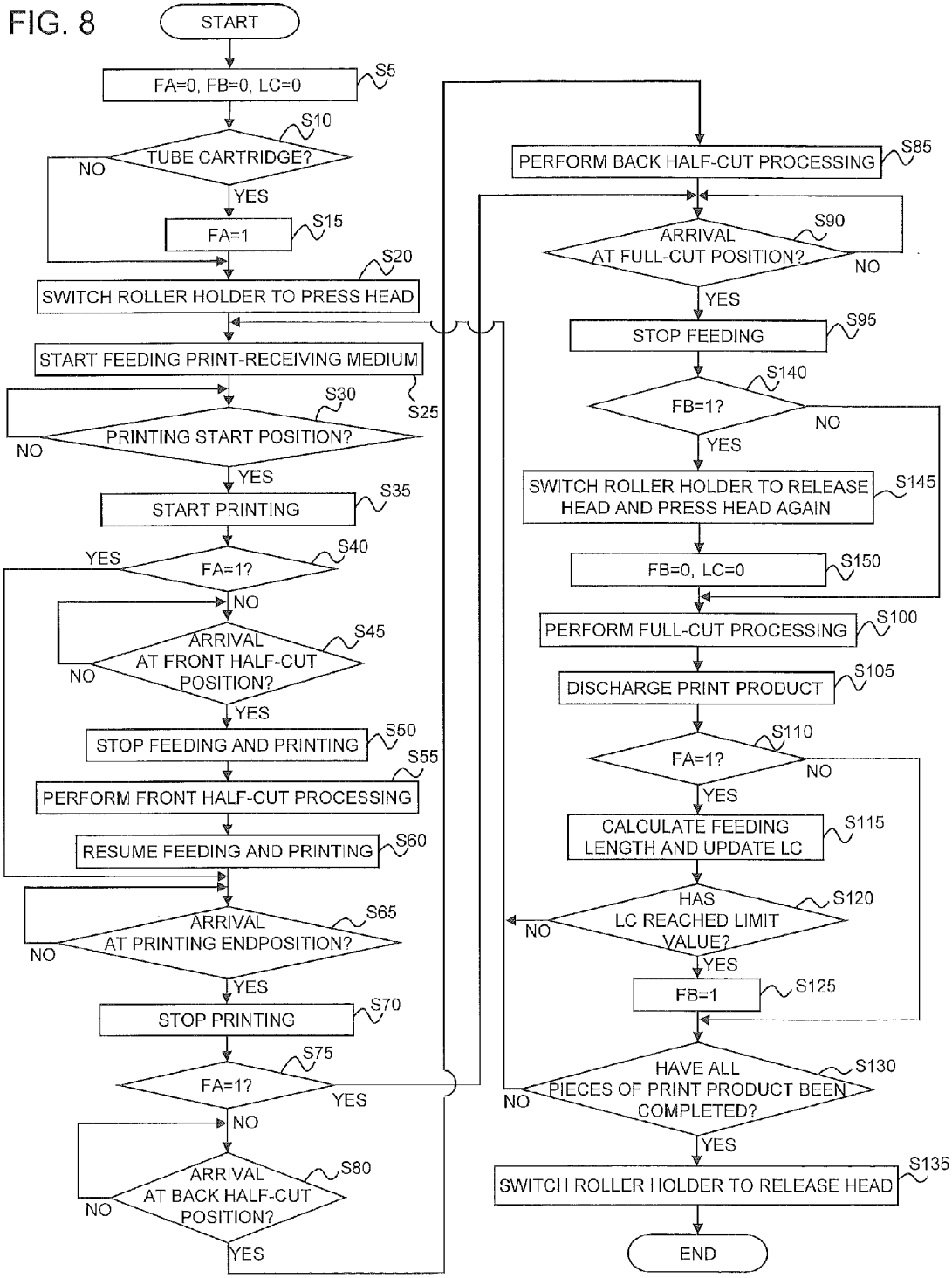
FIG. 8 is a flowchart illustrating control steps executed by the CPU of the control system in a modification example in which control is made such that a roller holder is switched to a separation state at predetermined timing before printing processing in operation is ended, and then further switched to a pressing state.

An example of the control step executed by the above described CPU 111 in the modification example will be described with reference to FIG. 8. As illustrated in FIG. 8, in the flow, the difference is that steps S140, S145, and S150 provided between step S130 and step S25 in FIG. 7 are moved to between steps S95 and S100.

Since, as illustrated in FIG. 8, steps S5-S95 perform the same processing as that in FIG. 7, the description will not be repeated. In the above described step S90, when it is determined that the print-receiving medium 101 has arrived at the full-cut position (YES, in step S90), and the feeding is stopped in the above described step S95, subsequently, the processing proceeds to the above described step S140.

Processing contents in steps S140, S145, and S150 are the same as those in FIG. 7. In other words, in step S140, the CPU 111 determines whether or not the feeding-length limit flag FB indicates FB=1. When the feeding-length accumulation value LC of the print-receiving medium 101 reaches the limit value and FB=1 is indicated, the determination is satisfied (YES in step S140), in step S145, in a similar manner to step S135, the CPU 111 executes switching from the above described pressing state to separation state to pressing state. In step S150, the CPU 111 resets the feeding-length limit flag FB and the feeding-length accumulation value LC to "0" and the processing proceeds to the above described step S100 for performing the full-cut processing.

Since steps S100-S135 perform the same processing as that in FIG. 7, the description will not be repeated.

According to the present modification example, as described above, when the accumulation value LC reaches the limit value, right before the full-cut processing (step S100) in the middle of the print processing, switching from the above described pressing state to separation state to pressing state is performed. With this arrangement, along with a whole-cut operation by the cutting mechanism 15 reliably stopping feeding the print-receiving medium 101, the roller holder 25 is reliably switched to the above described separation state so that expansion of the above described tube-shaped structure with the air can be reliably suppressed. As a result, occurrence of the feeding failure inside the tube cartridge can be suppressed.

As described above, after the feeding-length accumulation value LC has reached the limit value first (refer to the above described step S120) and the above described switching is performed during the full-cut processing (refer to the above described step S145), the above described accumulation value LC is reset (refer to the above described step S150) and counting is performed again so that the above described switching is performed during the full-cut processing each time the feeding-length accumulation value LC reaches the limit value. However, the present disclosure is not limited to the switching described above. In other words, after the feeding-length accumulation value LC has reached the limit value first, (without performing the above described reset of the accumulation value LC), the above described switching may be performed each time the full-cut is performed.

Further, as described above, right before the full-cut processing (step S100) in the middle of the print processing, switching from the above described pressing state to separation state to pressing state is performed. However, the present disclosure is not limited to the switching described above. Right after the full-cut processing, for example, right before the printed matter is discharged (step S105), the above described switching may be performed. Further, not right before or right after the full-cut processing as described above, a step may be provided to stop feeding the print-receiving medium 101 at appropriate timing during the printing processing (steps S25-S130) in the above described flow and the above described switching may be performed. In this case also, in a similar manner as described above, occurrence of the feeding failure inside the tube cartridge can be suppressed.

(1-2) Others

A phenomenon in which the tube-shaped structure of the print-receiving medium 101 expands with the accumulated air as described above tends to occur particularly noticeable when an ambient environment has a comparatively high temperature. Therefore, a temperature sensor (not illustrated) may be provided for detecting a temperature of the ambient environment of the printer 1 at an appropriate position in the apparatus. In this case, when it is determined that the tube cartridge is mounted in step S10 in the above described FIGS. 7, 8, further when it is determined that the above described accumulation value LC has reached the above described limit value in step S120, and furthermore when, corresponding to the above described determinations, in the newly provided step (not illustrated), the temperature of the above described ambient environment is higher than the above described limit temperature, switching from the above described pressing state to separation state to pressing state is performed. With this arrangement, it is reliably detected that the temperature of the ambient environment of the printer 1 is high, and based on the detection state, the above described switching can be performed. With this arrangement, occurrence of the feeding failure due to the expansion of the tube-shaped structure of the print-receiving medium 101 can be reliably suppressed.

With reference to diagrams, the printer according to a second embodiment of the present disclosure will be described. "front", "back", "left, "right", "up", and "down" described below indicate directions of "front", "back". "left", "right", "up", and "down" indicated in Figs, respectively.

<Outline of External Appearance of Apparatus>

Figure 9:
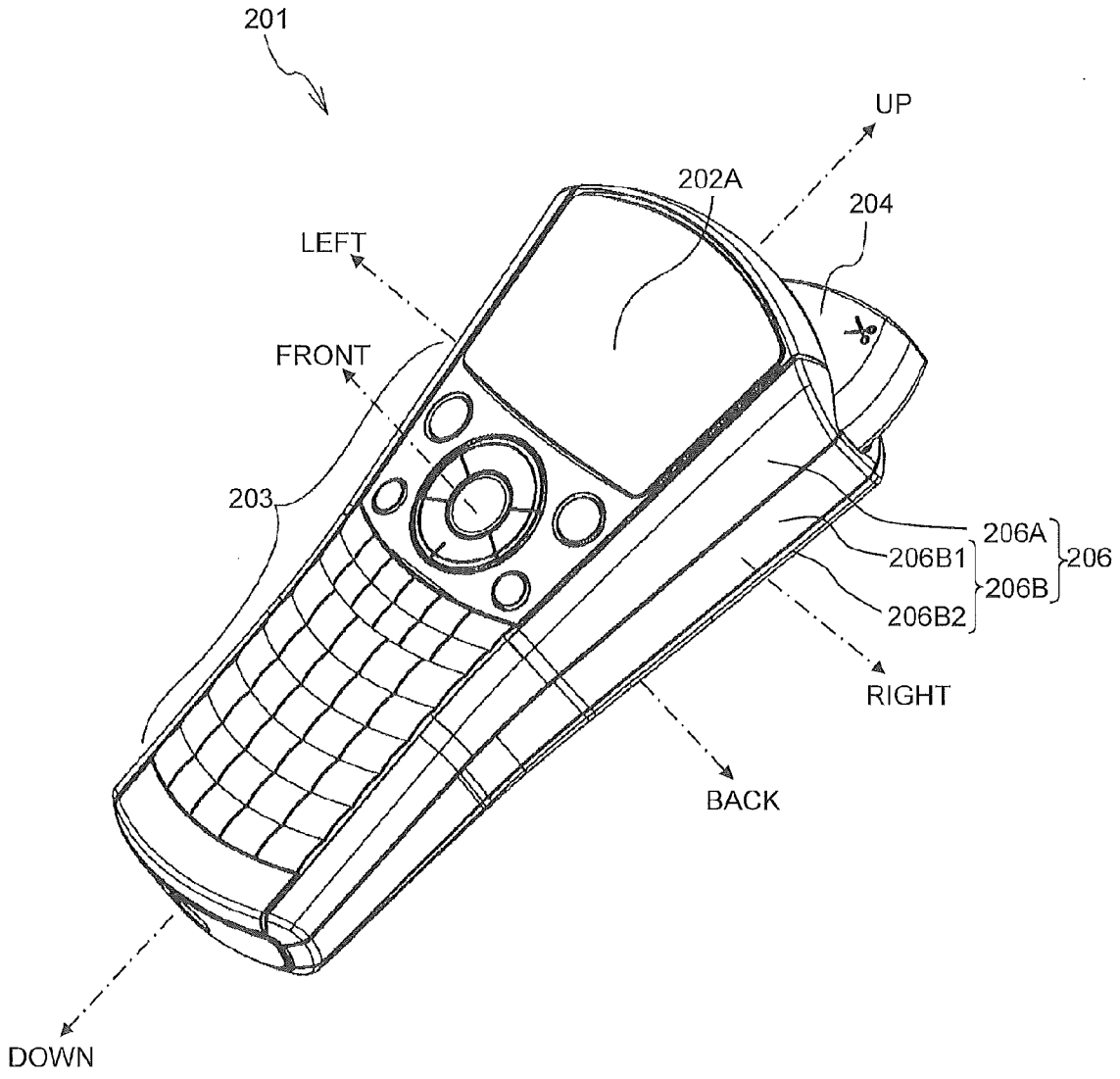
FIG. 9 is a perspective view illustrating an external appearance of a printer according to a second embodiment of the present disclosure.

As illustrated in FIG. 9, a printer 201 according to the present embodiment is a so-called hand-held type printer including a housing 206 held by a user's hand. The housing 206 includes a front cover 206A included in a front face of the apparatus, and a back cover 206B included in a back face thereof. Further, the back cover 206B includes a back cover main body 206B 1 incorporating various types of mechanism and a removable cover 206B2 that can be removed from the back cover main body 206B1 when a cartridge 231 (refer to FIG. 11 described below) and a battery (not illustrated) are removed.

On an upper side of the above described front cover 206A, a display part 260 (refer to FIG. 12 described below) for displaying various types of setting screens is provided. A front face of the display part 260 is covered with a cover panel 202A, which is a transparent acrylic plate or the like, for example. On a lower side of the cover panel 202A, an operation part 203 for operating the printer 201 is provided. The operation part 203 includes character keys for characters, symbols, and numbers, various types of function keys, appropriate buttons and the like. When the user inputs contents desired to be printed and formed based on an operation of the operation part 203, corresponding print data is created, and the contents are displayed on the display part 260. Further, on a top edge at a right side of the cover main body 206B1, a cutting lever 204 for cutting a print-receiving medium with print 270 (refer to FIG. 11 described below) is provided.

<Internal Structure of Apparatus>

Figure 10:
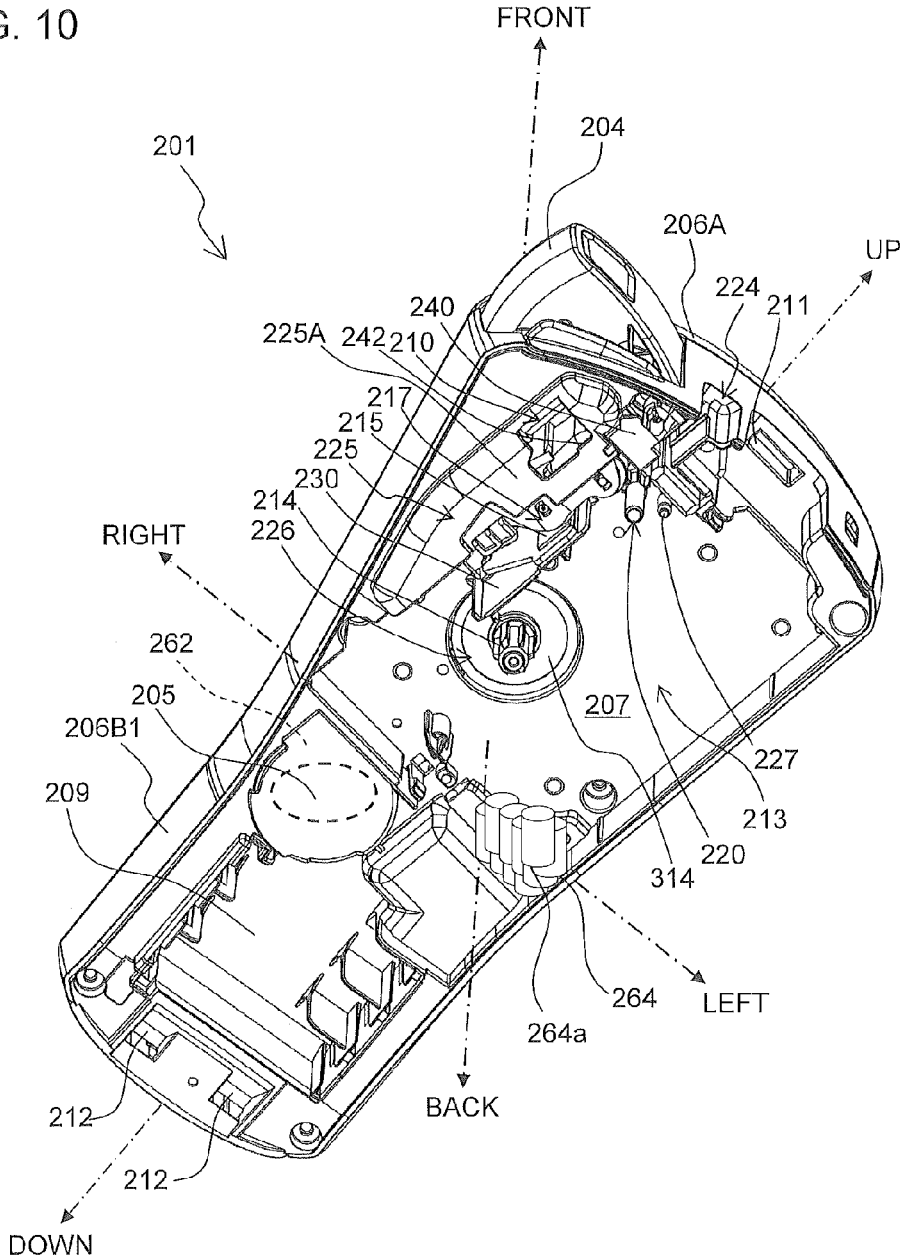
FIG. 10 is a perspective view illustrating an internal structure of the printer without a cartridge mounted.
Figure 11:
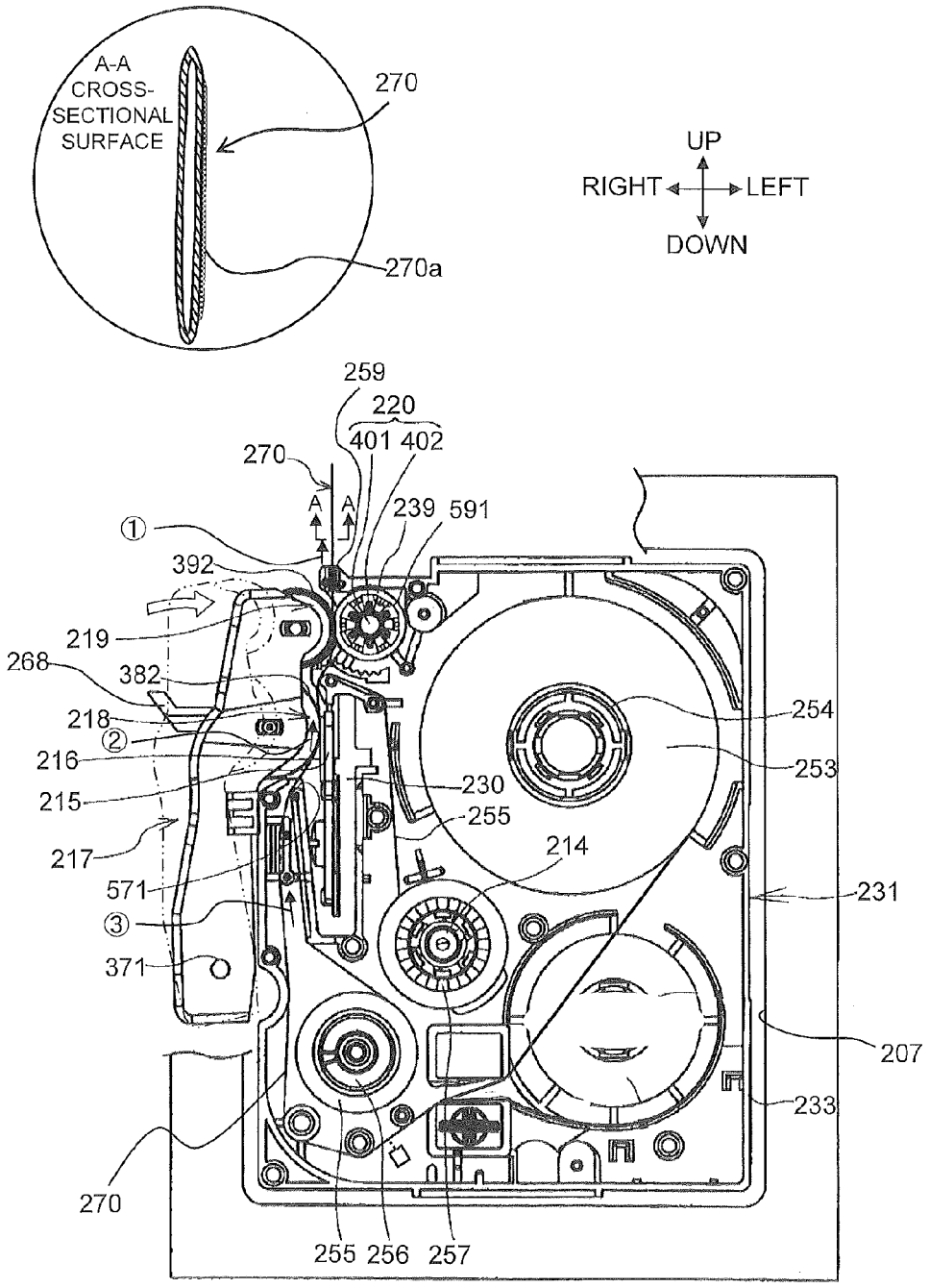
FIG. 11 is a plan view illustrating the internal structure of the cartridge mounted into a cartridge holder.

The internal structure of the printer 201 will be described with reference to FIGS. 10, 11. FIG. 10 is a perspective view illustrating the internal structure of the printer 201 viewed from the back side thereof with a removable cover 206B2 removed. FIG. 11 is a plan view illustrating an internal structure of the cartridge 231 mounted in a cartridge holder 207 of the printer 201.

As illustrated in FIG. 10, inside the printer 201, a frame 213 molded with resin, for example, is disposed. On an upper half portion of the back side of the frame 213, the concave cartridge holder 207 having a rectangular shape in a planar view for mounting and removing the cartridge 231 is provided.

On a lower side of the cartridge holder 207, a motor-storage portion 205 storing a drive motor 262 is provided. On a further lower side of the motor-storage portion 205, a battery-storage portion 209 for storing batteries is provided. Further, on a corner portion on a lower left side of the above described cartridge holder 207, a cartridge sensor 264 is provided on which a plurality of detection rods 264*a* that can freely advance and retreat is erected.

The cartridge sensor 264 can detect a type (i.e., attributes of the print-receiving medium 270 such as whether the print-receiving medium 270 has a tubular shape or a tape-like shape, and further what is the dimension of the print-receiving medium 270 in the width direction) of the cartridge 231 mounted in the cartridge holder 207 based on combinations of on and off of the detection rods 264*a* inserted into a plurality of to-be-detected holes (not illustrated) provided on the lower left portion of a front side of the cartridge case 233 of the cartridge 231 when the cartridge 231 is mounted in the cartridge holder 207, and output a corresponding detection signal.

On an upper portion of the above described frame 213, as illustrated in FIG. 10, a discharging slit 224 for discharging the above described print-receiving medium 270 with print to the outside is formed. Further, on the upper half portion of a right side of the frame 213, a roller holder 217 is provided. On a back side of the roller holder 217, a plate portion 225 made of synthetic resin to cover the roller holder 217 is provided. On an upper portion of the plate portion 225, a projecting-portion inserting opening 210 is provided. Further, on an upper edge portion of the back cover main body 206B 1, a lock hole 211 is provided, and on a lower edge portion thereof, a lock hole 212 is provided at two places.

On a substantially center portion of the above described frame 213, a gear recessed portion 226 formed in a recessed shape is provided. A gear (not illustrated) is provided in the gear recessed portion 226, and a teeth portion of the gear is covered with a hiding umbrella portion 314 and thus not exposed. On a back side of the gear, a ribbon winding shaft 214 is erected for winding up an ink ribbon 255 (refer to FIG. 11) of the cartridge 231.

Further, on a right side of the ribbon winding shaft 214, a rib 230 is erected. On a right side face of the rib 230, a heatsink 215 that is a rectangular heat dissipation plate is provided. Between the rib 230 and the discharging slit 224, a roller shaft 220 is erected for driving a sending roller 239 of the cartridge 231 (refer to FIG. 11). On a left side of the roller shaft 220, a projecting portion 227 is erected. The projecting portion 227 determines a position of the cartridge 231 in a front and back direction when being inserted into a recessed portion (not illustrated) of the cartridge 231.

In the vicinity of the above described discharging slit 224 of the above described frame 213, a guide holder 240 is provided that stores therein a cutter holder (not illustrated) including a cutter blade.

In the vicinity of the above described discharging slit 224, the rib 242 is integrally formed with the frame 213. The rib 242 formed on the right side of the discharging slit 224 is erected vertically with respect to a planar back-face portion 225A of the above described plate portion 225.

As illustrated in FIG. 11, the above described roller holder 217 includes a platen roller unit 218 and a discharging roller unit 219. The platen roller unit 218 is disposed on a right side of the heatsink 215. The platen roller unit 218 includes a platen roller 382 and a platen roller gear (not illustrated). On a position facing the platen roller 382, a thermal head 216 provided on a right side face of the heatsink 215 is disposed.

The thermal head 216 includes a plurality of heating elements, which forms desired print on the above described print-receiving medium 270 fed by the platen roller 382 and the like.

The roller holder 217 is formed in an arm-like shape, and provided swingably in a right and left direction about a shaft support portion 371. When the print is formed, the roller holder 217 can be selectively switched by a manual operation between a pressing state where the platen roller 382 presses the print-receiving medium 270 to the thermal head 216 with a predetermined pressing force as indicated with solid lines in FIG. 11, and a separation state where the platen roller 382 is separated away from the print-receiving medium 270 as indicated with two-dot chain lines in FIG. 11.

In other words, one end of the roller holder 217 is inserted into the projecting-portion inserting opening 210 of the above described plate portion 225, and the other end portion is engaged with a projecting portion 268 projecting to a right side of the roller holder 217. Further, the roller holder 217 includes urging means (not illustrated) for urging the roller holder 217 in a counterclockwise direction, which is a separating direction from the cartridge 231. When the user manually mounts the removable cover 206B2 to the cover main body 206B 1, the mounted removable cover 206B2 presses the projecting portion 268 to move the roller holder 217 in a clockwise direction, which is the direction to the cartridge 231, against an urging force by the urging means. With this arrangement, the roller holder 217 is switched to the pressing state so that the platen roller 382 presses the print-receiving medium 270 to the thermal head 216 with a predetermined pressure. When the user manually removes the above described removable cover 206B2 from the cover main body 206B1, the roller holder 217 is moved in the counterclockwise direction with the urging force by the urging means. With this arrangement, the roller holder 217 is switched to the separation state, and the platen roller 382 is separated away from the print-receiving medium 270.

In place of switching the state of the roller holder 217 between the pressing state and the separation state by mounting/removing the removable cover 206B2 to/from the cover main body 206B1 as described above (with the removable cover 206B2 still mounted in the cover main body 206B1), the user may manually operate an appropriate lever or the like to switch the state of the roller holder 217 between the pressing state and the separation state. As described above, in place of a configuration where the platen roller 382 moves to/away from the thermal head 216, a position of the platen roller 382 may be fixed and the thermal head 216 may move to/away from the platen roller 382.

The platen roller gear is engaged with the gear (not illustrated) provided on a front side of the frame 213 and, when the platen roller gear to which the drive motor 262 transmits a power is rotated, the platen roller 382 is rotated accordingly. With this arrangement, when the roller holder 217 is switched to the above described press-contact state, the platen roller 382, while pressing the print-receiving medium 270 and the ink ribbon 255 to the thermal head 216, feeds the print-receiving medium 270 with its rotation in a direction of the discharging roller unit 219.

The discharging roller unit 219 includes a discharging roller 392 and a discharging roller gear (not illustrated). The discharging roller 392 is disposed in a position facing the roller shaft 220. The roller shaft 220 includes a columnar portion 401 formed in a columnar shape and six ribs 402 radially formed toward an outside from an outer periphery of the columnar portion 401. The roller shaft 220 is inserted into a shaft hole 591 of the sending roller 239 of the cartridge 231 to rotatably support the sending roller 239.

The discharging roller 392 is moved by a movement of the roller holder 217. When the print is formed, and when the roller holder 217 is switched to the above described pressing state, the discharging roller 392 presses the print-receiving medium 270 to the sending roller 239 with a predetermined pressing force, and feeds the print-receiving medium 270 in a forward direction along a feeding path (refer to an arrow (1) A, A) toward the above described discharging slit 224. When the roller holder 217 is switched to the above described separation state, the discharging roller 392 is separated away from the print-receiving medium 270.

The discharging roller gear is engaged with the gear (not illustrated) provided on the front side of the above described frame 213, and, when the discharging roller gear to which the drive motor 262 transmits the power rotates, the discharging roller 392 rotates accordingly. When the print is formed, and when the roller holder 217 is switched to the above described pressing state, the discharging roller 392 presses the print-receiving medium 270 with print on which the printing has been performed by the thermal head 216 as described above to the sending roller 239 rotatably supported by the roller shaft 220. With this arrangement, the print-receiving medium 270 with print is discharged via the discharging exit 259. Thereafter, the print-receiving medium 270 with print is fed by the discharging roller 392 and the like to be guided to the above described discharging slit 224, and discharged to the outside of the printer 201 via the discharging slit 224. Thereafter, the user operates a cutting lever 204 to cut the print-receiving medium 270 with the above described cutter blade.

In an appropriate position in the housing 206, a temperature sensor 266 (refer to FIG. 12 described below) is provided. The temperature sensor 266 can detect a temperature in an ambient environment of the printer 201 and output a corresponding detection signal.

<Detailed Cartridge Structure>

The detailed structure of the cartridge 231 will be described below. According to the present embodiment, the cartridge 231 includes a tube cartridge for supplying a print-receiving tube in a flat tubular shape as the print-receiving medium 270 and a tape cartridge for supplying a print-receiving tape in a tape-like shape as the print-receiving medium 270. Hereinafter, the tube cartridge as the cartridge 231 is mainly described as an example. However, the tape cartridge has a structure similar to that of the tube cartridge except the shape of the print-receiving medium 270 as described above.

As illustrated in FIG. 11, the cartridge 231 (corresponding to the tube cartridge in this example as described above) includes the above described cartridge case 233 in a substantially rectangular shape mounted in the cartridge holder 207. On a lower portion of a left side in the cartridge case 233, a ribbon spool 256 around which the above described ink ribbon 255 is wound is rotatably disposed. The ink ribbon 255 fed out from the ribbon spool 256 is guided toward a cartridge opening 571. Further, on an upper portion of a right side in the cartridge case 233, the above described sending roller 239 including the shaft hole 591 is provided.

On a side adjacent to an obliquely left upper side of the above described ribbon spool 256, a ribbon take-up spool 257 is rotatably disposed. The ribbon take-up spool 257 draws the ink ribbon 255 from the ribbon spool 256 and also winds up the ink ribbon 255 consumed in printing characters, diagrams, images and the like. Further, on an upper left side of the cartridge 231, a print-receiving medium roll 253 is provided. The print-receiving medium roll 253 (in this example, a flat tubular shape) is acquired when the print-receiving medium 270 is wound around a reel portion 254 including an axis in a direction orthogonal to a tube longitudinal direction (vertical direction with respect to a paper surface in FIG. 11), and rolled.

As illustrated in an enlarged diagram of an A-A cross section in FIG. 11, the print-receiving medium 270 is formed with an image receiving layer 270*a* on a front surface of the print-receiving medium roll 253 on an inner peripheral side in a radial direction by surface treatment. The print-receiving medium 270 is wound around the reel portion 254 with the image receiving layer 270*a* set as the inner peripheral side. The image receiving layer 270*a* includes a transparent film made of print-receiving material, for example, and performs the printing by thermal transfer of the ink by being overlapped with the ink ribbon 255.

When the cartridge 231 is the tape cartridge described above, as the print-receiving medium 270 (not illustrated), a print-receiving tape in a similar manner to the above described image receiving layer 270*a* is provided that includes the image receiving layer 270*a* on which the printing is performed by the thermal transfer of the ink on a front surface at one side, which is to be the inner peripheral side (not illustrated). The print-receiving tape is configured in, for example, a three-layer structure in which a film formed of PET (polyethylene terephthalate) including the image receiving layer, an adhesive layer including appropriate adhesive material, and a separation sheet are sequentially layered.

<Functional Configuration of Control System>

Figure 12:
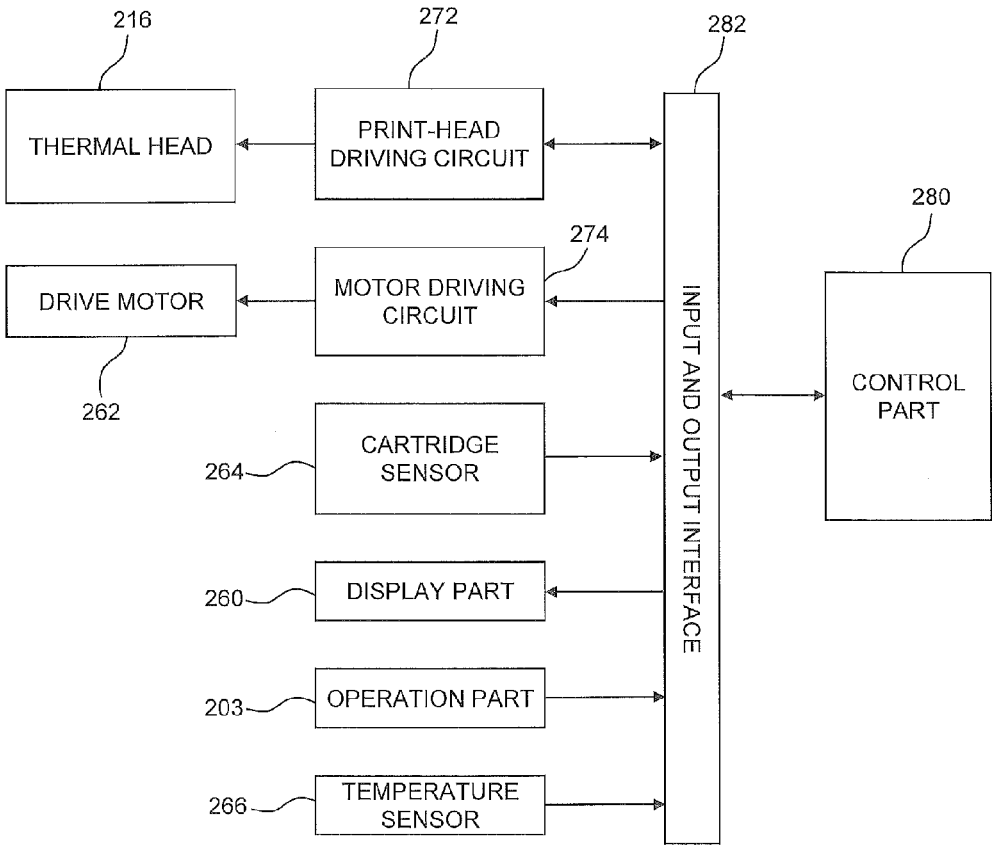
FIG. 12 is a functional block diagram illustrating a functional configuration of the control system of the printer.

FIG. 12 illustrates a control system in the printer 201.

As illustrated in FIG. 12, the printer 201 includes a control part 280 including a microprocessor, for example. The control part 280 is connected with a print-head driving circuit 272 for controlling energization of the above described thermal head 216, a motor driving circuit 274 for controlling the drive of the above described drive motor 262, the above described cartridge sensor 264, the above described operation part 203, the above described display part 260, and the above described temperature sensor 266 via an input and output interface 282.

<Basic Operation of Printer>

Operations of the printer 201 in the above described configuration will be described below.

As illustrated in FIG. 11 described above, when the cartridge 231 is mounted into the cartridge holder 207, the print-receiving medium 270 fed out from the print-receiving medium roll 253 is arranged to go through the cartridge opening 571 and pass between the thermal head 216 and the platen roller 382. Further, the ink ribbon 255 fed out from the ribbon spool 256 is arranged to be guided and regulated by a regulating projecting portion (not illustrated) of the cartridge 231, go through the cartridge opening 571 to be overlapped with the print-receiving medium 270, and pass between the thermal head 216 and the platen roller 382 with the overlapped state.

When, for example, the user inputs an appropriate operation instruction for forming the print via the above described operation part 203, a corresponding instruction signal is input into the control part 280 via the input and output interface 282 (refer to step S210 in FIG. 13 described below), and the printing is started under the control of the control part 280. In other words, the above described platen holder 217 is driven to rotate in the clockwise direction in FIG. 11, and the platen roller 382 is pressed toward the thermal head 216 so as to hold the print-receiving medium 270 and the ink ribbon 255 therebetween. Along with this pressing, the platen roller 382 is driven to rotate by the above described motor driving circuit 274 to feed the print-receiving medium 270 and the ink ribbon 255 to the downstream side (refer to an arrow (2) at the upper side in FIG. 11), while bringing them into press contact.

Simultaneously with pressing and feeding by the platen roller 382, the above described print-head driving circuit 272 drives the above described heating element to perform thermal transfer of the ink of the ink ribbon 255 onto the above described image receiving layer 270*a* on the surface at a thermal head 216 side (ink ribbon 255 side) of the print-receiving medium 270, thereby forming the desired print on the print-receiving medium 270.

Subsequently, the ink ribbon 255 fed out to the downstream side of the thermal head 216 is separated from the print-receiving medium 270 via a separation member (not illustrated), and then wound up by the ribbon take-up spool 257. Then, the print-receiving medium 270 with print that is fed out to the downstream side of the thermal head 216 and separated from the ink ribbon 255 is discharged outside the cartridge 231 via the discharging exit 259, and then passes through the cutter blade (not illustrated) to be fed out in an arrow (1) direction in FIG. 11.

When the print-receiving medium 270 advances a predetermined distance, feeding is stopped. Subsequently, the cutter blade acts to cut the print-receiving medium 270. With this arrangement, the printed matter (when the above described tube cartridge is used, the tube with print, and when the above described tape cartridge is used, the print label) having a predetermined length can be acquired.

<Features of Second Embodiment>

When the above described tube cartridge is used as the cartridge 231 (appropriately denoted as "tube cartridge 231" hereinafter), since the print-receiving medium 270 has a tubular shape, as the tubes with print are sequentially produced as described above, the air inside the tube moves to the upstream side of a position of the platen roller 382 in the transport direction. Thus, the air is easily accumulated inside the tubular structure and if it is once accumulated therein, it can be hardly removed. As a result, if the tubular structure expands with the accumulated air, there may occur a feeding failure of the print-receiving medium 270 inside the tube cartridge 231.

Therefore, in the present embodiment, when the printing processing is sequentially performed on the tubular print-receiving medium 270 for a certain period with the tube cartridge 231 mounted, predetermined limit on the above described printing processing is performed (in this example, after a part of the printing processing in operation is completed, the printing processing thereafter is prohibited). Further, as the predetermined limit, in addition to the above described limit, after all printing processing in operation is completed, the subsequent printing processing may be prohibited (refer to a modification example in FIG. 14 described below), or the printing processing in operation may be stopped.

<Control Steps>

To perform limit of the above described printing processing, the control steps performed by the above described control part 280 will be described with reference to FIG. 13. The flow in FIG. 13 is started when the user turns ON the power of the printer 201, for example.

Figure 13:
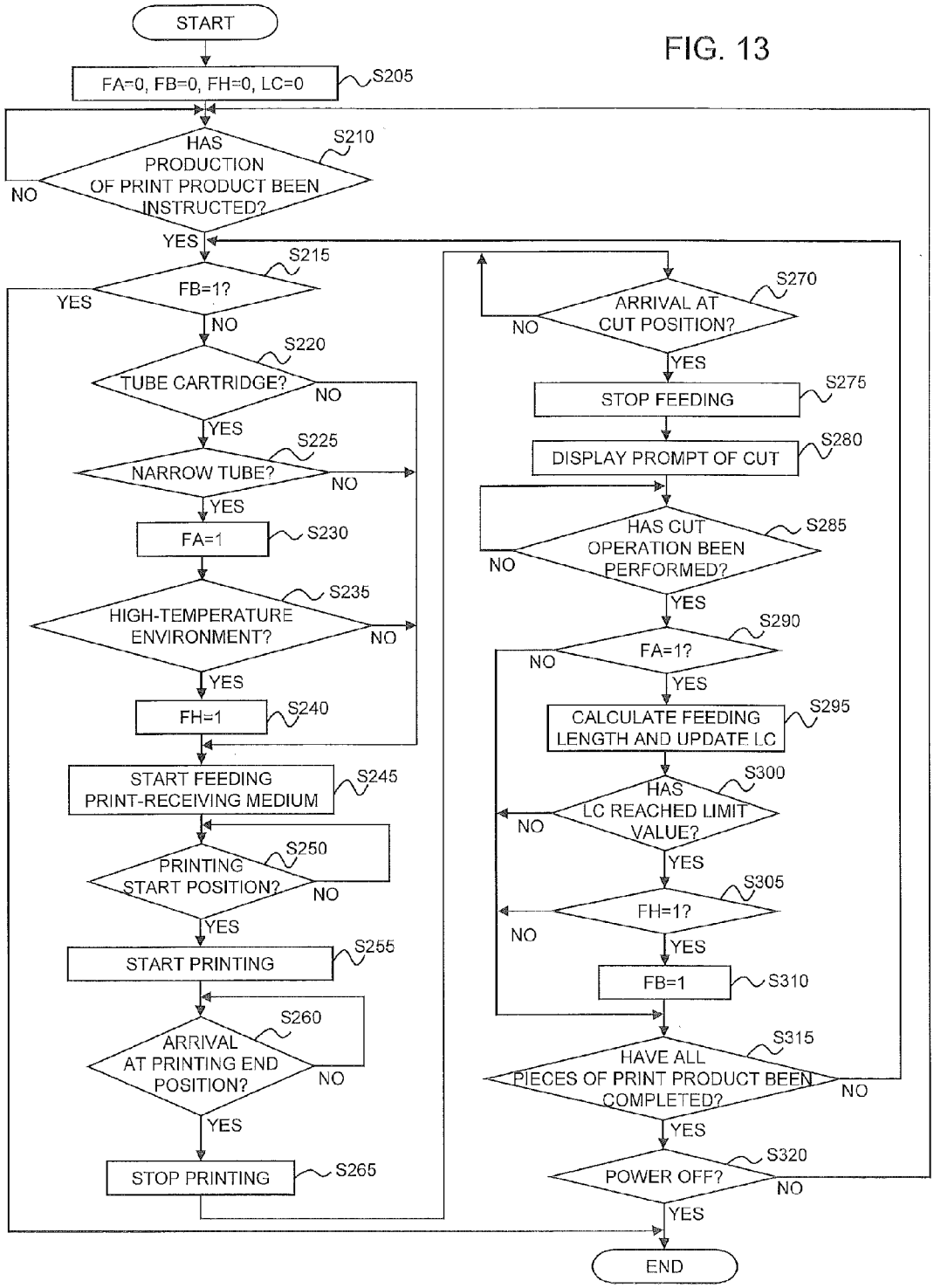
FIG. 13 is a flowchart illustrating the control steps executed by the control portion of the control system.

In FIG. 13, first in step S205, in a similar manner to step S5 in FIG. 7 of the above described first embodiment, the control part 280 resets all of the tube cartridge flag FA, the feeding length limit flag FB, and a high-temperature flag FH to "0" and further the feeding length accumulation value LC to "0". The tube cartridge flag FA indicates that the cartridge 231 is a tube cartridge including a narrow print-receiving tube, and the feeding length limit flag FB indicates that an accumulation value of the feeding lengths of the print-receiving medium 270 fed by the platen roller 382 has reached a limit value (details will be described below), and the high-temperature flag FH indicates that a temperature of an ambient environment of the printer 201 is higher than a predetermined limit temperature (details will be described below). When step S205 is ended, the processing proceeds to step S210.

In step S210, the control part 280 determines whether or not the operator has given an instruction for producing the above described printed matter (including the number of pieces of the printed matter to be produced). Until the operator gives the instruction for producing the printed matter using the operation part 203, the determination is not satisfied (NO, in step S210), and the processing waits in a loop. When the instruction for producing the printed matter is given, the determination is satisfied (YES, in step S210), and the processing proceeds to step S215.

In step S215, the control part 280 determines whether or not the feeding length limit flag FB indicates FB=1. As described below, when the feeding length of the print-receiving medium 270 reaches the limit value, and the flag FB indicates FB=1, the determination is satisfied (YES, in step S215), and the flow is ended. On the other hand, when the feeding length of the print-receiving medium 270 has not reached the limit value, and the flag FB indicates FB=0, the determination is not satisfied (NO, in step S215), and the processing proceeds to step S220.

In step S220, in a similar manner to step S10 in FIG. 7 of the above described first embodiment, based on a detection result of the above described cartridge sensor 264, the control part 280 determines whether or not the cartridge 231 mounted in the cartridge holder 207 is the above described tube cartridge. As described above, when the user mounts the cartridge 231 into the cartridge holder 207, the cartridge sensor 264 detects the type of the mounted cartridge 231 (i.e., the attribute of the print-receiving medium 270). When the cartridge sensor 264 detects that the mounted cartridge 231 is the tube cartridge for supplying the above described print-receiving tube, the determination is satisfied (YES, in step S220), and the processing proceeds to step S225. When the cartridge sensor 264 detects that the mounted cartridge 231 is the tape cartridge for supplying the print-receiving tape, the determination is not satisfied (NO, in step S220), and the processing proceeds to step S245 described below.

In step S225, based on the detection result of the cartridge sensor 264, the control part 280 determines whether or not a dimension of the above described print-receiving medium 270 (i.e., the above described print-receiving tube) included in the above described cartridge 231 in the width direction has a small width, which is a predetermined limited dimension or less. When the dimension of the print-receiving medium 270 in the width direction is the above described small width, the determination is satisfied (YES, in step S225), and the processing proceeds to step S230. When the dimension of the print-receiving medium 270 in the width direction is not the above described small width, the determination is not satisfied (NO, in step S225), and the processing proceeds to step S245 described below.

In step S230, the control part 280 sets the above described tube cartridge flag FA to FA=1, and the processing proceeds to step S235.

In step S235, based on the detection result of the temperature sensor 266, the control part 280 determines whether or not the temperature in the ambient environment of the printer 201 is higher than a predetermined limit temperature (e.g., one temperature appropriately set within a range between 30° C.-80° C.). When the temperature detected by the temperature sensor 266 is in a high-temperature state in which the temperature is higher than the above described limit temperature, the determination is satisfied (YES, in step S235), and the processing proceeds to step S240. When the temperature detected by the temperature sensor 266 is the above described limit temperature or lower, the determination is not satisfied (NO, in step S235), and the processing proceeds to step S245.

In step S240, the control part 280 sets the high-temperature flag FH to FH=1, and the processing proceeds to step S245.

In step S245, in a similar manner to step S25 in FIG. 7 of the above described first embodiment, the control part 280 outputs a control signal to the motor driving circuit 274 via the input and output interface 282 to rotate and drive the sending roller 239 and the platen roller 382 with a drive force of the drive motor 262. With this arrangement, the print-receiving medium 270 is fed out from the print-receiving medium roll 253 and also the ink ribbon 255 is fed out from the ribbon spool 256, and they are overlapped and fed in the above described forward direction. Subsequently, the processing proceeds to step S250.

In step S250, in a similar manner to step S30 in FIG. 7 of the above described first embodiment, the control part 280 determines whether or not the print-receiving medium 270 has arrived at a printing start position by the thermal head 216 (i.e., whether or not the print-receiving medium 270 has been fed to a position where the thermal head 216 faces a front edge position of a predetermined printing area of the print-receiving medium 270 in the transport direction). This determination may be made by determining, for example, whether the print-receiving medium has been fed a predetermined distance from start of feeding the print-receiving medium in step S245. The determination of the predetermined distance may be made by counting, for example, the number of pulses output by the motor driving circuit 274 driving the drive motor 262 that is the pulse motor since the timing in the above described step S245, and whether the count number has reached a predetermined value corresponding to the above described predetermined distance. Alternatively, it may be determined whether a predetermined time has elapsed from start of feeding the tape. Until the print-receiving medium 270 arrives at the printing start position, the determination is not satisfied (NO, in step S250), and the processing waits in a loop. When the print-receiving medium 270 has arrived at the printing start position, the determination is satisfied (YES, in step S250), and the processing proceeds to step S255.

In step S255, in a similar manner to step S35 in FIG. 7 of the above described first embodiment, the control part 280 outputs the control signal to the print-head driving circuit 272 via the input and output interface 282 to energize the thermal head 216. With this arrangement, the ink of the ink ribbon 255 is transferred onto the above described printing area of the image receiving layer 270*a* of the print-receiving medium 270 to start printing desired print such as characters, symbols, and barcodes corresponding to previously created, desired print data. Subsequently, the processing proceeds to step S260.

In step S260, in a similar manner to step S65 in FIG. 7 of the above described first embodiment, the control part 280 determines whether or not the print-receiving medium 270 has arrived at the printing end position by the thermal head 216 (i.e., whether or not the print-receiving medium 270 has been fed to a position where the thermal head 216 faces the back edge position of the above described printing area in the transport direction). The determination at this point, as described above, may be made by counting the number of pulses for driving the drive motor 262. Until the print-receiving medium 270 arrives at the printing end position, the determination is not satisfied (NO, in step S260), and the steps are repeated. When the print-receiving medium 270 has arrived at the printing end position, the determination is satisfied (YES, in step S260), and the processing proceeds to step S265.

In step S265, in a similar manner to step S70 in FIG. 7 of the above described first embodiment, the control part 280 outputs the control signal to the print-head driving circuit 272 via the input and output interface 282 to stop energizing the thermal head 216 and further stop printing the above described desired print. With this arrangement, printing the desired print on a printing area of the print-receiving medium 270 is completed. Subsequently, the processing proceeds to step S270.

In step S270, the control part 280 determines whether or not the print-receiving medium 270 with print is fed to a cutting position (i.e., whether or not the print-receiving medium 270 with print has arrived at a position where the cutting blade of the cutter holder in the guide holder 240 faces a previously set cutting line). The determination at this point also, as described above, may be made by counting the number of pulses for driving the drive motor 262. Until the print-receiving medium 270 with print arrives at the cutting position, the determination is not satisfied (NO, step S270), and the steps are repeated. When the print-receiving medium 270 with print has arrived at the cutting position, the determination is satisfied (YES, in step S270), and the processing proceeds to step S275.

In step S275, in a similar manner to step S95 in FIG. 7 of the above described first embodiment, the control part 280 outputs the control signal to the motor driving circuit 274 via the input and output interface 282 to stop driving the drive motor 262 and further stop rotating the sending roller 239, the platen roller 382 and the like. With this arrangement, feeding out the print-receiving medium 270 from the print-receiving medium roll 253, drawing the ink ribbon 255 from the ribbon spool 256, and feeding the print-receiving medium 270 with print are stopped with the cutter blade facing a line of the above described cutting position. Subsequently, the processing proceeds to step S280.

In step S280, the control part 280 outputs the control signal to the display part 260 to cause the display part 260 to display a prompt to cut the print-receiving medium 270 with print. When step S280 is ended, the processing proceeds to step S285.

In step S285, the control part 280 determines whether or not the user has performed a cutting operation on the print-receiving medium 270 with print. If the user operates the cutting lever 204 to cut the print-receiving medium 270 with print according to the display on the display part 260 in the above described step S280, the printed matter on which the desired printing has been performed (when the print-receiving medium 270 is the above described print-receiving tube, the tube with print, and when the print-receiving medium 270 is the print-receiving tape, the print label) is created. Until the cutting operation is performed, the determination is not satisfied (NO, in step S285), and the steps are repeated. When the cutting operation has been performed, the determination is satisfied (YES, in step S285), and the processing proceeds to step S290.

In step S290, in a similar manner to step S110 in FIG. 7 of the above described first embodiment, the control part 280 determines whether or not the tube cartridge flag FA indicates FA=1. As described above, when the cartridge 231 mounted in the cartridge holder 207 is the tube cartridge including a narrow print-receiving tube, FA=1 is indicated. If the cartridge 231 is other than the tube cartridge, FA=0 is indicated. When the flag FA indicates FA=1, the determination is satisfied (YES, in step S290), and the processing proceeds to step S295. When the flag FA indicates FA=0, the determination is not satisfied (NO, in step S290), and the processing proceeds to step S315 described below.

In step S295, in a similar manner to step S115 in FIG. 7 of the above described first embodiment, the control part 280 calculates the feeding length of the print-receiving medium 270 (i.e., print-receiving tube) fed by the platen roller 382. The feeding length is calculated by a method for counting the number of pulses for driving the above described drive motor 262, for example. At this point, the control part 280 accumulates the feeding lengths to be calculated in step S295 by repetition to be described below each time the repetition is performed, to calculate the accumulation value LC. In other words, the new feeding length calculated in step S295 is added to the above described accumulation value LC calculated in step S295 so far, to update the accumulation value to a new accumulation value LC. When step S295 is ended, the processing proceeds to step S300.

In step S300, in a similar manner to step S120 in FIG. 7 of the above described first embodiment, the control part 280 determines whether or not the feeding length accumulation value LC updated in the above described step S295 has reached the limit value (e.g., 5 m) of the predetermined feeding length. The above described limit value of the feeding length is defined as an upper limit of the feeding length of the print-receiving medium 270 fed by the platen roller 382 from the view point of determining the state of the feeding operation that causes the above described air moment inside the tube of the tube cartridge 231. When the feeding length accumulation value LC has reached the limit value, the determination is satisfied (YES, in step S300), and the processing proceeds to step S305. When the feeding length accumulation value LC has not reached the limit value, the determination is not satisfied (NO, in step S300), and the processing proceeds to step S315.

In step S305, the control part 280 determines whether or not the high-temperature flag FH indicates FH=1. When the temperature in the above described ambient environment is higher than the above described limit temperature and FH=1 is indicated (refer to the above described step S240), the determination is satisfied (YES in step S305), and the processing proceeds to step S310. When the temperature in the above described ambient environment is the above described limit temperature or lower and FH=0 is indicated, the determination is not satisfied (NO in step S305), and the processing proceeds to step S315 described below.

In step S310, in a similar manner to step S125 in FIG. 7 of the above described first embodiment, the control part 280 sets to FB=1 the above described feeding length limit flag FB representing that the feeding length accumulation value LC of the print-receiving medium 270 fed by the platen roller 382 has reached the above described limit value, and the processing proceeds to step S315.

In step S315, in a similar manner to step S130 in FIG. 7 of the above described first embodiment, the control part 280 determines whether or not producing the whole number of pieces of the above described printed matter specified by the instruction for producing the printed matter input in the above described step S210 has been completed. When producing the whole number of the pieces of the printed matter has not been completed, the determination is not satisfied (NO, in step S315), and the processing returns to the above described step S215 to repeat the same steps. With this arrangement, until producing the above described whole number of the pieces of the printed matter is completed, the above described steps S215-S310 are repeated. When the tube cartridge 231 including the narrow print-receiving tube is used, the feeding length accumulation value LC at the time point is sequentially updated in step S295. While the repetition is performed, when the accumulation value LC to be updated has reached the above described limit value, and further the ambient temperature of the printer 201 is higher than the above described limit temperature, the processing returns from step S315 to step S215 with the above described feeding length limit flag FB set to "1" in step S310. When the determination in step S215 is satisfied, this flow is ended. In this case, of the number of pieces specified by the instruction in step S210, the tubes with print up to the time point when the flag FB indicates FB=1 in step S310 are produced, but the subsequent number of pieces of the tubes with print are not produced. In other words, producing a part of the whole number of pieces of tubes with print is completed according to the instruction in step S210, but the subsequent processing will be prohibited.

On the other hand, in step S315, when producing the whole number of pieces of the printed matter has been completed, the determination is satisfied (YES, in step S315), and the processing proceeds to step S320. In step S320, the control part 280 determines whether or not the power is turned off. When the user turns off the power, the determination is satisfied (YES, in step S320), and the flow is ended. When the user does not turn off the power, the determination is not satisfied (NO, in step S320), and the processing returns to the above described step S210 to wait for the subsequent instruction for producing the printed matter, and repeats the same steps.

As described above, the feeding lengths of the print-receiving medium 270 fed by the platen roller 382 are accumulated to update the above described accumulation value LC, and then whether or not the accumulation value LC has reached the limit value is determined, but the present disclosure is not limited thereto. In other words, in place of the above described feeding lengths, the print lengths on the print-receiving medium 270 (in the transport direction) by the thermal head 216 may be accumulated to update the accumulation value, and then whether or not the accumulation value of the print lengths has reached a predetermined limit value may be determined.

<Advantages of Second Embodiment>

As described above, according to the printer 201 of the present embodiment, the tube cartridge 231 is mounted in the cartridge holder 207, the tubular print-receiving medium 270 (corresponding to the above described print-receiving tube) is fed, and the desired print is formed on the fed print-receiving medium 270 so that the user can use it as the tube with print.

According to the present embodiment, depending on the feeding operation state of the print-receiving medium 270, that can directly cause the above described air movement inside the tube, the predetermined limit is performed on the printing processing. In other words, when the cartridge 231 mounted in the cartridge holder 207 is the tube cartridge, the feeding lengths of the print-receiving medium 270 are accumulated. When the accumulated value has reached the above described limit value, the above described predetermined limit is performed (in this example, the subsequent printing processing is prohibited). With this arrangement, an amount of the air in the tube is decreased due to natural air leakage from the print-receiving medium 270 during a predetermined period until the above described prohibition is released. As a result, in new printing processing (in this case, the flow in FIG. 13 is newly started in step S205) after the above described prohibition has been released, easy expansion of the print-receiving medium 270 having the above described tubular structure with the air accumulated as described above can be suppressed, and also occurrence of the feeding failure inside the tube cartridge 231 can be suppressed.

A phenomenon in which the tubular structure of the above described print-receiving medium 270 is expanded with the accumulated air as described above tends to be noticeable particularly when the temperature in the ambient environment is comparatively high. Thus, according to the present embodiment, particularly, the temperature sensor 266 for detecting the temperature in the ambient environment of the printer 201 is provided. When it is determined in step S220 in FIG. 13 that the tube cartridge is mounted, when it is determined in step S300 that the above described accumulation value LC has reached the above described limit value, and further when it is determined in step S235 that the temperature in the above described ambient environment is higher than the above described limit temperature, the above described predetermined limit is performed.

With this arrangement, in the present embodiment, it is reliably detected that the temperature in the ambient environment of the printer 201 is in a high-temperature state, and based on the detected state, the predetermined limit can be performed on the above described printing processing. With this arrangement, after the above described predetermined limit is performed, the ambient temperature of the printer 201 is decreased so that occurrence of the feeding failure due to the expansion of the tubular structure of the print-receiving medium 270 can be reliably suppressed.

Further, the smaller the width of the print-receiving medium 270 is, the more the expansion of the tube due to the above described accumulated air in the tubular print-receiving medium 270 tends to occur. According to the present embodiment, particularly, when it is determined in step S220 that the tube cartridge is mounted, when it is determined in step S300 that the above described accumulation value LC has reached the above described limit value, and further when it is determined in step S225 that a dimension of the print-receiving medium 270 in the width direction is the predetermined limit dimension or less, the predetermined limit is performed on the above described printing processing. With this arrangement, occurrence of the feeding failure due to the expansion of the tubular structure of the print-receiving medium 270 can be reliably suppressed.

According to the present embodiment, (a) the mounted cartridge 231 is the tube cartridge (refer to step S220 in FIG. 13), (b) the feeding length accumulation value LC has reached the limit value (refer to step S300 in FIG. 13), (c) the temperature in the ambient environment of the printer 201 is in the high-temperature state in which the temperature is higher than the predetermined limit temperature (refer to step S235 in FIG. 13), (d) the width dimension of the print-receiving medium 270 is the predetermined value or less, when the four conditions of above described (a)-(d) are all satisfied, the subsequent printing processing is prohibited (stopped) from being performed, but the present disclosure is not limited thereto. In other words, as the conditions for the above described prohibition (stop), the conditions of above described (c) and (d) are not always necessary, only (a), (b), (c), or only (a), (b), (d), or only (a), (b) may be adopted.

The above described second embodiment is not limited to the above described mode but various types of modifications can be adopted without departing from the scope of the disclosure and the technical ideas thereof. Such a modification example will be sequentially described below.

(2-1) When, after the Entire Printing Processing in Operation has been Completed, Predetermined Limit is Performed on Printing Processing:

In the above described second embodiment, as described above, as the above described predetermined limit, when a part of the printing processing in operation has been completed, the subsequent printing processing is prohibited. However, when the entire printing processing in operation has been completed, the above described printing processing may be prohibited.

An example of control steps performed by the above described control part 280 in such a modification example will be described with reference to FIG. 14. Same reference numerals are applied to equivalent steps in the above described FIG. 13, and the descriptions are not repeatedly described appropriately or they are simplified.

Figure 14:
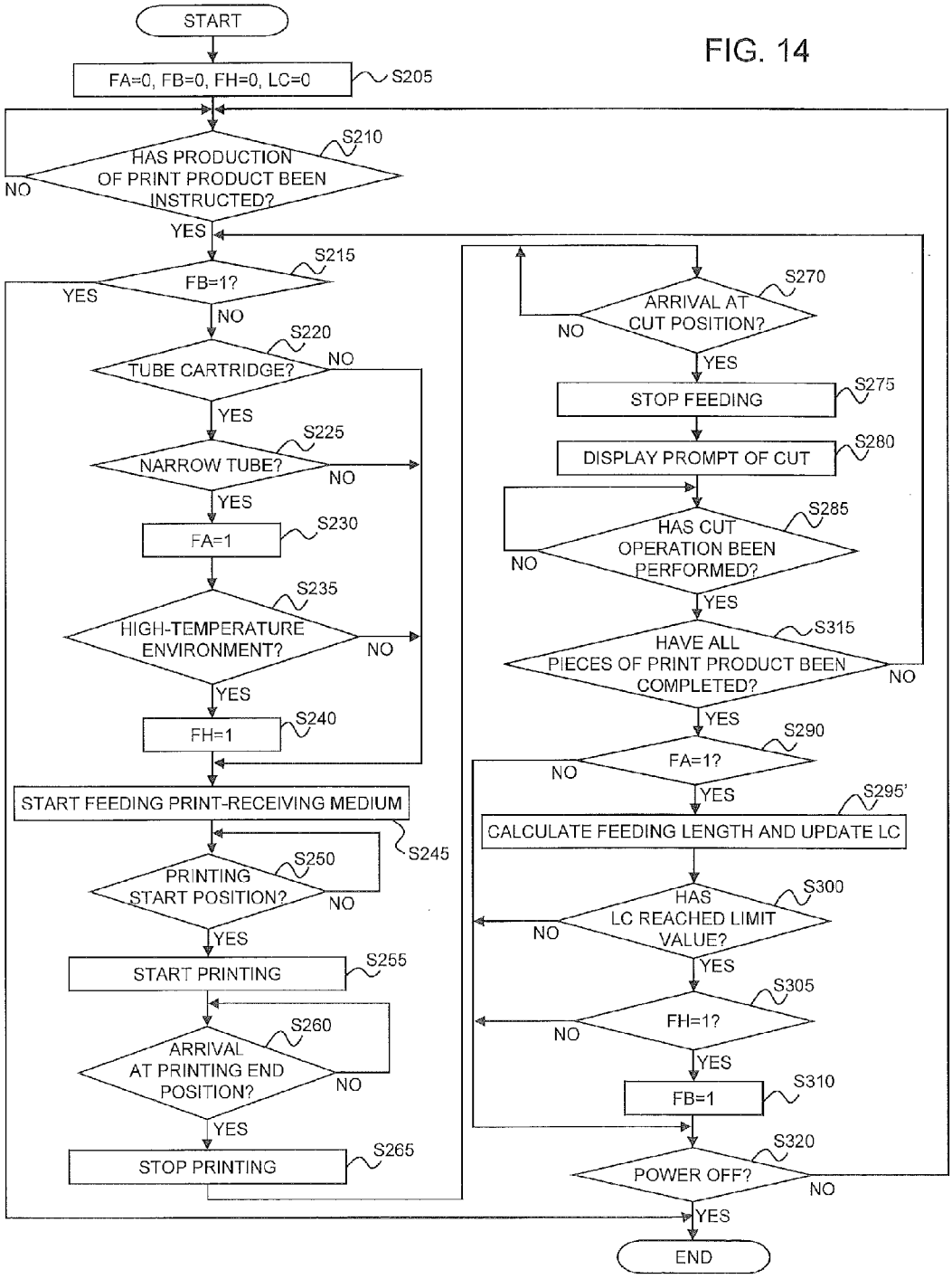
FIG. 14 is a flowchart illustrating the control steps executed by the control portion in a modification example in which, after all printing processing in operation is completed, predetermined limit is performed on the printing processing.

In FIG. 14, difference is that the flow includes step S295' in place of step S295 in the flow in FIG. 13, and further, the above described step S315 is moved between the above described step S290 and the above described step S295'. In other words, steps S205-S285 are the same as those in FIG. 13, and they are not described herein. When it is determined that the cutting operation is performed in the above described step S285 (YES, in step S285), the processing proceeds to the above described step S315.

In step S315, in a similar manner to the above described second embodiment, the control part 280 determines whether or not producing the whole number of pieces of the printed matter specified by the instruction for producing the printed matter input in the above described step S210 has been completed. When producing the whole number of pieces of the printed matter has not been completed, the determination is not satisfied (NO, in step S315), and the processing returns to the above described step S215 to repeat the same steps. With this arrangement, until producing the above described whole number of pieces of the printed matter has been completed, the above described steps S215-S285 are repeated. When producing the whole number of pieces of the printed matter has been completed, the determination in step S315 is satisfied (YES, in step S315), and the processing proceeds to step S290.

In step S290, in a similar manner to the above described second embodiment, the control part 280 determines whether or not the tube cartridge flag FA indicates FA=1. When the cartridge 231 is the tube cartridge including the narrow print-receiving tube, and also the flag FA indicates FA=1, the determination is satisfied (YES, in step S290), and the processing proceeds to step S295'. When the flag FA indicates FA=0, the determination is not satisfied (NO, in step S290), and the processing proceeds to step S320 described below.

In step S295', the control part 280 tallies the whole feeding lengths of the print-receiving medium 270 (i.e., print-receiving tube) fed by the platen roller 382 in repetition of steps S215-S285 described above (the feeding length fed each time the processing is performed once in the steps S215-S285 may be stored in an appropriate place). At this point, in a similar manner to the above described step S295 of the second embodiment, the control part 280 adds the feeding length newly calculated in step S295' to the above described accumulation value LC calculated in the step S295' so far to update the accumulation value as a new accumulation value LC. When step S295' is ended, the processing proceeds to step S300.

In step S300, in a similar manner to the above described second embodiment, the control part 280 determines whether or not the feeding length accumulation value LC updated in the above described step S295' has reached the predetermined feeding length limit value (e.g., 5 m). When the feeding length accumulation value LC has reached the limit value, the determination is satisfied (YES, in step S300), and the processing proceeds to step S305. When the feeding length accumulation value LC has not reached the limit value, the determination is not satisfied (NO, in step S300), and the processing proceeds to step S320.

In step S305, in a similar manner to the above described second embodiment, the control part 280 determines whether or not the high-temperature flag FH indicates FH=1. When the above described temperature of the ambient environment is higher than the above described limit temperature and FH=1 is indicated, the determination is satisfied (YES, in step S305), and the processing proceeds to step S310. When the above described temperature of the ambient environment is the above described limit temperature or lower and FH=0 is indicated, the determination is not satisfied (NO, in step S305), and the processing proceeds to step S320.

In step S310, in a similar manner to the above described second embodiment, the control part 280 sets the above described feeding length limit flag FB to FB=1 in response to the above described accumulation value LC having reached the above described limit value, and the processing proceeds to step S320.

In step S320, in a similar manner to the above described second embodiment, the control part 280 determines whether or not the power is turned off. When the user has turned off the power, the determination is satisfied (YES, in step S320), and the flow is ended. When the user has not turned off the power, the determination is not satisfied (NO, in step S320), and the processing returns to the above described step S210 to wait for the subsequent instruction for producing the printed matter, and repeats the same steps. With this arrangement, when the tube cartridge 231 including the narrow print-receiving tube is used, when the accumulation value LC acquired by tallying the whole feeding lengths has reached the above described limit value, and further when the ambient temperature of the printer 201 is higher than the above described limit temperature, the processing returns from step S320 to step S210 with the above described feeding length limit flag FB set to "1" in step S310. When the subsequent instruction for producing the printed matter is input and the determination is satisfied in the step S215 after the determination is satisfied in step S210, the flow is ended. In other words, unlike the above described second embodiment, when execution of the printing processing is started on the number of pieces of the printed matter specified by the instruction in step S210 in a certain number of times of the processing, the tubes with print up to the time point where the FB=1 is indicated in step S310, and also the subsequent number of the tubes with print are produced (i.e., the whole number of pieces of tubes are produced). In other words, after producing the whole number of pieces of the tubes with print according to the instruction in step S210 is completed, new printing processing for the subsequent times (by the input of the instruction for producing the printed matter in step S210) is prohibited.

As described above, in the present modification example, until the above described printing processing in operation for the whole number of pieces of the above described printed matter is ended (YES, in step S315), the feeding length limit flag FB does not indicate FB=1 (in step S310). Thus, when the entire printing processing in operation is all completed, the above described predetermined limit (in this example, the subsequent printing processing is prohibited) is performed. With this arrangement, the amount of the air in the tube can be decreased due to the natural air leakage from the print-receiving medium 270 after the prohibition. As a result, in the new printing processing after the above described prohibition is released (in this case, in a similar manner to the above described second embodiment, a new flow in FIG. 14 is started from step S205), easy expansion of the above described print-receiving medium 270 in the tubular structure due to the accumulated air described above can be suppressed, thereby suppressing occurrence of the feeding failure inside the tube cartridge 231.

(2-2) When Display is Performed for Prompting to Switch from Pressing State of Roller Holder to Separation State Thereof:

As described above, when the print is formed, the roller holder 217 can be selectively switched via an operation on the removable cover 206B2 mounted/removed to/from the cover main body 206B1 with the user's manual operation between the pressing state in which the platen roller 382 presses the print-receiving medium 270 to the thermal head 216 with the predetermined pressing force, and the separation state in which the platen roller 382 is separated away from the print-receiving medium 270. In response to this switching, in the present modification example, when the predetermined limit is performed on the printing processing as described above, on the display part 260, the display is performed for prompting to switch (i.e., removing the removable cover 206B2) the above described roller holder 217 from the above described pressing state to the separation state.

For example, in the above described flow illustrated in FIG. 13, a new step is provided (not illustrated) to which the processing proceeds when the determination of whether or not the feeding length limit flag FB in the above described step S215 indicates FB=1 is satisfied. In step S215, in a similar manner to the above described step S280, the control part 280 outputs the control signal to the display part 260 to perform the display for prompting to switch the roller holder 217 (from the above described pressing state to the separation state) with the manual operation on the display part 260. When this step is ended, the flow is ended.

In the present modification example, according to the display on the display part 260 in the above described new step, the roller holder 217 is switched from the above described pressing state to the separation state so that the print-receiving medium 270 can be released from the pressed state between the platen roller 382 and the thermal head 216. As a result, even if the air is accumulated in the print-receiving medium 270 having the tubular structure as described above, the accumulated air can be removed from the tube edge to the outside. As a result, occurrence of the feeding failure can be further reliably suppressed.

As described above, the arrows illustrated in FIGS. 6, 12 indicate an example of the flows of the signals, and they do not limit the flow directions of the signals.

Further, the flowcharts illustrated in FIGS. 7, 8, 13, 14 do not limit the present disclosure to the steps illustrated in the above described flows, but the steps may be added and deleted, or orders may be changed without departing from the scope of the disclosure and the technical ideas thereof. For example, when the feeding length is calculated in step S295, prior to the printing processing, the feeding length to be fed can be also calculated in advance.

Furthermore, as described above, when it is detected that the tube cartridge is mounted in the cartridge holders 6, 207, and also when the feeding length accumulation value of the print-receiving mediums 101, 270 has reached the above described limit value, the predetermined processing (in the above described example, the platen roller 26 is switched between pressing and separating, or subsequent printing processing is prohibited) for suppressing the expansion with the air inside the tube is performed, but, the present disclosure is not limited thereto. In other words, when it is detected that the tube cartridge is mounted in the cartridge holders 6, 207, every time the printing processing is performed a predetermined number of times (e.g., each time), or every time when a predetermined time elapses, the switch between pressing and separating may be performed.

Moreover, in addition to the examples described above, appropriate combinations of methods of the above described embodiments and each modification example may be used.

What is claimed is:

1. A printer configured to perform printing processing that forms desired print on a print-receiving medium, comprising:

a cartridge holder configured to removably mount a cartridge configured to feed out and sequentially supply said print-receiving medium;

a drive device configured to drive a feeding roller configured to feed said print-receiving medium supplied from said cartridge;

a thermal head configured to perform printing on said print-receiving medium fed by said feeding roller;

an energization device configured to control energization of said thermal head;

an attribute detecting device configured to detect an attribute of said print-receiving medium in said cartridge mounted on said cartridge holder;

a first determination portion configured to determine whether or not a tube cartridge capable of supplying a tubular print-receiving medium is mounted, based on a detection result of said attribute detecting device; and a processing portion configured to perform predetermined processing that is for suppressing expansion of said tubular print-receiving medium and is triggered by the determination that said tube cartridge has been mounted by said first determination portion.

2. The printer according to claim 1, further comprising:

an accumulation portion configured to accumulate printing lengths along a transport direction or feeding lengths, when said printing processing is performed on said print-receiving medium; and a second determination portion configured to determine whether or not an accumulation value of said printing lengths or said feeding lengths has reached a predetermined limit value, based on an accumulation result by said accumulation portion, wherein said processing portion performs said predetermined processing that is for suppressing the expansion of said tubular print-receiving medium and is triggered by the determination that said tube cartridge has been mounted by said first determination portion and the determination that said accumulation value has reached said limit value by said second determination portion.

3. The printer according to claim 2, further comprising a switch device configured to selectively switch a relative positional relationship between said feeding roller and said thermal head, into a pressing state that said feeding roller presses said print-receiving medium to said thermal head with a predetermined pressing force at forming said print or a separation state that said feeding roller is separated away from said print-receiving medium, wherein said processing portion is a switch control portion configured to control said switch device so as to switch said relative positional relationship between said feeding roller and said thermal head from said pressing state to said separation state, and then further from said separation state to said pressing state.

4. The printer according to claim 3, further comprising:

a temperature detecting device configured to detect a temperature of an ambient environment of said printer; and a third determination portion configured to determine whether or not an environment temperature when production of a printed matter is started is higher than a predetermined limit temperature, based on a detection result by said temperature detecting device, wherein said switch control portion performs a control to said switch device so that the relative positional relationship between said feeding roller and said thermal head is switched from said pressing state to said separation state and then further is switched from said separation state to said pressing state, and that is triggered by the determination that said tube cartridge has been mounted by said first determination portion, the determination that said accumulation value has reached said limit value by said second determination portion, and the determination that said temperature of the ambient environment is higher than said limit temperature by said third determination portion.

5. The printer according to claim 3, wherein:

said switch control portion controls said switch device so as to switch said relative positional relationship from said pressing state to said separation state, and then further from said separation state to said pressing state, before start of said printing processing.

6. The printer according to claim 3, wherein:

said switch control portion controls said switch device so as to switch said relative positional relationship from said pressing state to said separation state, and then further from said separation state to said pressing state, at predetermined timing before ending said printing processing in operation.

7. The printer according to claim 6, further comprising a cutting device configured to cut said print-receiving medium on which said print is formed by said printing processing in a thickness direction, wherein said switch control portion controls said switch device so as to switch said relative positional relationship from said pressing state to said separation state, and then further from said separation state to said pressing state, at said predetermined timing, right before or right after said cutting device performs said cutting.

8. The printer according to claim 2, wherein:

said processing portion is a limit control portion configured to control said drive device and said energization device in coordination with each other so as to perform predetermined limit on said printing processing.

9. The printer according to claim 8, further comprising;

a temperature detecting device configured to detect a temperature of an ambient environment of said printer; and a third determination portion configured to determine whether or not an environment temperature when production of a printed matter is started is higher than a predetermined limit temperature, based on a detection result by said temperature detecting device, wherein said limit control portion performs a control to said drive device and said energization device in coordination with each other so as to perform the predetermined limit on said printing processing, and that is triggered by the determination that said tube cartridge has been mounted by said first determination portion, the determination that said accumulation value has reached said limit value by said second determination portion, and the determination that said temperature of the ambient environment is higher than said limit temperature by said third determination portion.

10. The printer according to claim 8, further comprising a fourth determination portion configured to determine whether or not a dimension of said print-receiving medium in a width direction is a predetermined limit dimension or less, based on a detection result by said attribute detecting device, wherein said limit control portion performs a control to said drive device and said energization device in coordination with each other so as to perform the predetermined limit on said printing processing, and that is triggered by the determination that said tube cartridge has been mounted by said first determination portion, the determination that said accumulation value has reached said limit value by said second determination portion, and the determination that said dimension in the width direction is said limit dimension or less by said fourth determination portion.

11. The printer according to claim 8, wherein:

said limit control portion controls said drive device and said energization device in coordination with each other so as to prohibit execution of subsequent said printing processing after completion of all or a part of said printing processing in operation, as said predetermined limit.

12. The printer according to claim 8, further comprising:

a switch device configured to selectively switch a relative positional relationship between said feeding roller and said thermal head, into a pressing state that said feeding roller presses said print-receiving medium to said thermal head with a predetermined pressing force at forming said print or a separation state that said feeding roller is separated away from said print-receiving medium; and a display device configured to perform display prompting switching by said switch device from said pressing state to said separation state, when said limit control portion performs said predetermined limit.

13. A printer comprising:

a cartridge holder configured to removably mount a cartridge comprising a print-receiving medium;

a head configured to perform printing on said print-receiving medium supplied from said cartridge;

a roller;

a switch device configured to selectively switch a relative positional relationship between said roller and said head into a first relative position or a second relative position where a distance from said roller to said head in said first relative position is shorter than the distance from said roller to said head in said second relative position;

an attribute detecting device configured to detect an attribute of said print-receiving medium in said cartridge mounted on said cartridge holder;

a first determination portion configured to determine whether or not a tube cartridge capable of supplying a tubular print-receiving medium is mounted, based on a detection result of said attribute detecting device; and a switch control portion configured to perform a control that cause said switch device so as to switch said relative positional relationship between said roller and said head from said first relative position to said second relative position and is triggered by a determination that said tube cartridge has been mounted by said first determination portion.

14. A printer comprising:

a cartridge holder configured to removably mount a cartridge comprising a print-receiving medium;

a head configured to perform printing on said print-receiving medium supplied from said cartridge;

a roller;

a switch device configured to selectively switch a relative positional relationship between said roller and said head into a first relative position or a second relative position where a distance from said roller to said head in said first relative position is shorter than the distance from said roller to said head in said second relative position;

an attribute detecting device configured to detect an attribute of said print-receiving medium in said cartridge mounted on said cartridge holder;

a first determination portion configured to determine whether or not a tube cartridge capable of supplying a tubular print-receiving medium is mounted, based on a detection result of said attribute detecting device; and a display device configured to perform display that prompts switching by said switch device from said first relative position to said second relative position and is triggered by a determination that said tube cartridge has been mounted by said first determination portion.

15. A printer comprising:

a cartridge holder configured to removably mount a cartridge comprising a print-receiving medium;

a head configured to perform printing on said print-receiving medium supplied from said cartridge;

an attribute detecting device configured to detect an attribute of said print-receiving medium in said cartridge mounted on said cartridge holder;

a first determination portion configured to determine whether or not a tube cartridge capable of supplying a tubular print-receiving medium is mounted, based on a detection result of said attribute detecting device; and a head control portion configured to perform a control that prohibits printing by said head and is triggered by a determination that said tube cartridge has been mounted by said first determination portion.

* * * * *